US006220348B1

(12) United States Patent
Serafin et al.

(10) Patent No.: US 6,220,348 B1
(45) Date of Patent: Apr. 24, 2001

(54) RETRIEVABLE BRIDGE PLUG AND RETRIEVING TOOL

(75) Inventors: Vitold Serafin, Calgary; Barry Tate, Strathmore; Piro Shkurti, Calgary, all of (CA)

(73) Assignee: Polar Completions Engineering Inc., Calgary (CA)

( * ) Notice: Subject to any disclaimer, the term of this patent is extended or adjusted under 35 U.S.C. 154(b) by 0 days.

(21) Appl. No.: 09/175,595

(22) Filed: Oct. 20, 1998

(51) Int. Cl.[7] ..... E21B 33/134

(52) U.S. Cl. ..... 166/133; 166/135; 166/145

(58) Field of Search ..... 166/63, 129, 133, 166/135, 145, 188, 192

(56) References Cited

U.S. PATENT DOCUMENTS

| | | | | |
|---|---|---|---|---|
| Re. 32,831 | | 1/1989 | Shonrock et al. | 166/135 |
| 3,815,676 | * | 6/1974 | Read | 166/133 X |
| 4,149,594 | * | 4/1979 | Evans | 166/133 X |
| 4,185,689 | | 1/1980 | Harris | 166/133 |
| 4,432,418 | * | 2/1984 | Mayland | 166/133 |
| 4,436,150 | | 3/1984 | Barker | 166/131 |
| 4,586,567 | * | 5/1986 | Jameson | 166/133 X |
| 4,595,052 | | 6/1986 | Kristiansen | 166/123 |
| 4,646,829 | * | 3/1987 | Barrington et al. | 166/125 |
| 4,648,446 | | 3/1987 | Fore et al. | 166/123 |
| 4,671,356 | | 6/1987 | Barker et al. | 166/285 |
| 4,693,309 | | 9/1987 | Caskey | 166/123 |
| 4,862,961 | | 9/1989 | Neff | 166/127 |
| 4,898,239 | | 2/1990 | Rosenthal | 166/133 |
| 4,928,762 | | 5/1990 | Mamke | 166/192 |
| 5,029,643 | * | 7/1991 | Winslow et al. | 166/133 X |
| 5,058,684 | | 10/1991 | Winslow et al. | 166/386 |
| 5,441,111 | | 8/1995 | Whiteford | 166/387 |
| 5,613,560 | | 3/1997 | Jelinski et al. | 166/387 |
| 5,678,635 | | 10/1997 | Dunlap et al. | 166/387 |
| 5,697,499 | * | 12/1997 | Hennig et al. | 166/133 X |
| 5,727,632 | | 3/1998 | Richards | 166/387 |

FOREIGN PATENT DOCUMENTS 2148197 4/1995 (CA) .

* cited by examiner

*Primary Examiner*—George Suchfield
(74) *Attorney, Agent, or Firm*—Tarolli, Sundheim, Covell, Tummino & Szabo, L.L.P.

(57) ABSTRACT

A retrievable bridge plug having an internal bypass passage and external retrieving lugs, and a retrieving tool therefor. When the bypass passage is sealed, both the top and bottom openings of the bypass passage are closed, preventing debris from entering the bypass passage through either opening. A directing shroud is provided adjacent the top opening of the bypass passage, such that when the bypass passage is opened, part of any fluid flowing uphole through the bypass passage is directed over the retrieving lugs, clearing them of any debris and facilitating latching by the retrieving tool. The shroud also prevents debris from packing around the top opening of the bypass passage. A retrieving tool is also provided, which retrieving tool, through cooperation of a sleeve having a "J" shaped slot, and an inner latch sleeve having a straight slot, locks the retrieving tool onto the retrieving lugs.

20 Claims, 17 Drawing Sheets

RETRIEVABLE BRIDGE PLUG AND RETRIEVING TOOL

FIELD OF THE INVENTION

The present invention relates to bridge plugs and retrieving tools therefor and in particular to retrievable bridge plugs which may be placed in pressurized oil and gas well bores to temporarily seal a portion of the well bore, and which require equalization before retrieval.

BACKGROUND OF THE INVENTION

Bridge plugs are tools which are typically lowered into a cased oil or gas well. When set in position inside the casing, a bridge plug provides a seal to isolate pressure between two zones in the well. Retrievable bridge plugs are often used during workover operations when a temporary separation of zones is required.

Typical bridge plugs are shown in U.S. Pat. No. 4,436,150 issued to Barker on Mar. 13, 1984; U.S. Pat. No. 4,898,239 issued to Rosenthal on Feb. 6, 1990; and U.S. Pat. No. 5,727,632 issued to Richards on Mar. 17, 1998. Retrievable bridge plugs typically have anchor elements and sealing elements. The anchor elements are used to grip the inside surface of the well casing, thereby preventing the bridge plug from moving up or down within the casing, once set. The sealing elements engage the inside surface of the well casing to provide the requisite seal between the plug and the casing. Typically, the bridge plug is set in position by radially extending the anchor elements and the sealing elements to engage the well casing. To retrieve the bridge plug from the well casing, a retrieving tool is lowered down the casing to engage a retrieving latch, which, through a retrieving mechanism, retracts the anchor elements and the sealing elements, allowing the bridge plug to be pulled out of the well bore.

During workover operations, a pressure differential across the plug often develops. It is desirable to equalize this pressure differential before the anchor and sealing elements are disengaged. Equalization prevents the loss of control over the bridge plug, wherein the tool may be blown up or down a well casing in response to the pressure differential. As exemplified by the prior art bridge plugs listed above, such equalization is typically effected through the opening of a bypass passage through the interior of the plug, prior to disengagement of the anchor and sealing elements.

However, a problem is often encountered with the effect of debris on the operation of the plug. Such debris may have an adverse effect on the operation of the plug. If sufficient debris remains on top of the plug, it may block the proper functioning of the mechanism used to open the bypass passage, making it very difficult, if not impossible for the pressure to equalize across the plug. Further, if a significant amount of debris accumulates on top of the bridge plug, it may be difficult, or impossible to engage the retrieving latch to retract the anchor and sealing elements Finally, debris accumulation inside the bridge plug may adversely affect the relative movement of various parts within the bridge plug.

With prior art retrievable bridge plugs, even with the bypass passage sealed, fluid in the well is allowed to enter the interior of the plug. Further, no structure protects the uphole opening of the bypass passage, and debris is allowed to accumulate adjacent this opening. Moreover, no means are provided by the bridge plug to protect, or clear the retrieving latch used to disengage the anchor and sealing elements.

With known retrieving tools, once the retrieving tool has latched onto the bridge plug, accidental unlatching of the bridge plug may occur due to jarring motions, or forces imparted on the bridge plug or retrieving tool when the bypass passage is opened. Also, while the bridge plug is being lifted out of the well bore, jarring, or friction against the well casing may cause the anchor elements to move to their extended positions, locking the bridge plug in place within the casing, necessitating emergency recovery procedures. Once the retrieving tool and bridge plug have been removed from the well bore, it is difficult to separate the two, additional machine often being required.

SUMMARY OF THE INVENTION

An object of the present invention is to provide a retrievable bridge plug and retrieving tool therefor which reduces the effect of debris on the-proper operation of the plug.

According to a broad aspect, the present invention provides a bridge plug for use in a well bore having a well wall, the bridge plug comprising: (a) an elongated body having an internal bypass passage; (b) anchors mounted on said elongated body, said anchors being extendible from a retracted position, in which they are held out of contact with the well wall, to an extended position in which they engage the well wall; (c) a seal mounted on said elongated body, said seal being extendible from a retracted position, in which it is held out of contact with the well wall, to an extended position in which it engages the well wall and forms an annular seal between the elongated body and the well wall; (d) a setting mechanism operable to set and lock said anchors and seal in their extended positions; (e) a release mechanism operable to disengage said anchors and seal from the well wall; (f) said internal bypass passage having a top and a bottom opening, said top opening located uphole from said seal, said bottom opening located downhole from said seal; (g) a top bypass closure adjacent said top opening of the internal bypass passage, and a bottom bypass closure adjacent said bottom opening of the internal bypass passage, each of said top and bottom bypass closures being mounted on said elongated body for movement between a first position in which the internal bypass passage is open, and a second position in which the internal bypass passage is sealed, and the top and bottom openings of the internal bypass passage are closed, substantially preventing debris from entering the internal bypass passage; and (h) a bypass sealing mechanism operable to move said top and bottom bypass closures between said first and second positions.

According to another aspect, the present invention provides a bridge plug for use in a well bore having a well wall, the bridge plug comprising; (a) an elongated body having an internal bypass passage; (b) anchors mounted on said elongated body, said anchors being extendible from a retracted position, in which they are held out of contact with the well wall, to an extended position in which they engage the well wall; (c) a seal mounted on said elongated body, said seal being extendible from a retracted position, in which it is held out of contact with the well wall, to an extended position in which it engages the well wall and forms an annular seal between the elongated body and the well wall; (d) a setting mechanism operable to set and lock said anchors and seal in their extended positions; (e) a release mechanism operable to disengage said anchors and seal from the well wall, said release mechanism being operable by a retrieving tool acting upon retrieving tool engaging elements mounted on the elongated body; (f) said internal bypass passage having a top and a bottom opening, said top opening located uphole from said seal, said bottom opening located downhole from said seal; (g) a directing shroud located over the top opening of the internal bypass passage; (h) a bypass sealing mechanism operable to selectively open and seal said internal bypass passage, whereby the directing shroud substantially protects the top opening of the internal bypass passage from debris and, when the internal bypass passage is open, directs part of any fluid flowing uphole through the internal bypass passage over the retrieving tool engaging elements.

According to a further aspect, the present invention provides a retrieving tool having top and bottom ends, for retrieving downhole tools from a well bore, such downhole tools having a top end and a plurality of transversely extending retrieving lugs, the retrieving tool comprising: (a) a tubing attachment interface for detachably attaching the retrieving tool to tubing; (b) a retrieving lug guide having a bottom end, said retrieving lug guide comprising a sleeve defining a plurality of J-shaped slots extending upward from its bottom end, the number of said J-shaped slots being equal to or greater than the number of retrieving lugs on the downhole tool and, each of said U-shaped slots being sized to accommodate a retrieving lug, each U-shaped slot having a stem portion and a hook portion, said stem portion of each J-shaped slot extending upward and obliquely from said bottom end of the retrieving lug guide, said hook portion of each J-shaped slot extending downward, said bottom end of said retrieving lug guide being provided with downward-pointing spade-shaped profiles between entrances to each J-shaped slot; (c) a latch sleeve mounted for reciprocal longitudinal movement within the retrieving tool, said latch sleeve having a bottom end, at least a portion of said latch sleeve overlapping a sufficient portion of said retrieving lug guide so as to substantially overlap an interface between the hook portion and stem portion of the J-shaped slots of said retrieving lug guide; said latch sleeve defining a plurality of latch slots extending upward from the bottom end of said latch sleeve, the number of said latch slots being equal to or greater than the number of retrieving lugs, said latch slots being sized to accommodate the retrieving lugs, said latch slots being aligned with the hook portions of the J-shaped slots of the retrieving lug guide; (d) each of said retrieving lug guide and latch sleeve having an inner diameter large enough to allow the retrieving lug guide and latch sleeve to pass over all portions of the downhole tool above the retrieving lugs, but small enough to cause engagement with the retrieving lugs; (e) a latch sleeve alignment mechanism to prevent the latch sleeve from rotating relative to the retrieving lug guide; (f) a latch sleeve biasing element to bias the latch sleeve downward relative to the retrieving lug guide; and (g) a rotation mechanism to allow the retrieving lug guide, latch sleeve, latch sleeve alignment mechanism and biasing element to rotate relative to the tubing attachment interface, whereby as the retrieving tool is lowered into the well on the end of the tubing, the retrieving lugs on the downhole tool first contact the bottom end of the retrieving lug guide, the spade-shaped profile of the bottom end of the retrieving tool guide causing the retrieving tool guide, latch sleeve, latch sleeve alignment mechanism and biasing element to rotate relative to the tubing attachment interface as the retrieving tool is lowered further, still further lowering causing the retrieving lugs to enter the stem portions of the a-shaped slots and then to bear against the bottom end of the latch sleeve causing the latch sleeve to move upwards against the biasing force provided by the biasing element, further downward movement of the retrieving tool causing the retrieving lugs to enter the hook portion of the J-shaped slots allowing the biasing element to force and retain the latch sleeve back down relative to the retrieving lug guide as the retrieving lugs enter the latch slots, thereby locking the retrieving lugs within the hook portion of the J-shaped slots of the retrieving lug guide.

According to a still further aspect, the present invention provides a downhole tool/retrieving tool combination for use in a well bore having a well wall comprising: (a) a downhole tool comprising anchors extendible from a retracted position in which the anchors are held out of contact with the well wall, to an extended position in which the anchors engage the well wall; (b) said downhole tool further comprising an anchor retracting mechanism for retracting the anchors to their retracted positions; and (c) a retrieving tool adapted to actuate said anchor retracting mechanism to retract the anchors to their retracted positions, and to maintain said anchors in their retracted positions while the downhole tool is raised out of the well bore.

Advantageously, the retrievable bridge plug of the present invention prevents debris from entering the interior of the plug when the internal bypass passage is sealed. Further, the top opening of the bypass passage is protected against buildup of debris by the shroud. Additionally, when the bypass passage is opened after the workover operations, part of any fluid passing upward through the bypass passage is directed by the shroud over the retrieving tool engaging elements, to clear them of debris. These advantages allow the retrievable bridge plug of the present invention to reduce the effect of debris on the proper operation of the plug.

Advantageously, the retrieving tool of the present invention prevents inadvertent disengagement of the retrieving lugs once the retrieving lugs are locked into the hook portion of the "J" shaped slot of the retrieving lug guide. Further, once the user has retracted the anchors on the downhole tool using the retrieving tool, the anchors are retained in their retracted position while the downhole tool is raised out of the well bore. Finally, the downhole tool/retrieving tool combination of the present invention allows the user to easily detach the downhole tool from the retrieving tool.

Other objects, features and advantages will be apparent from the following detailed description taken in connection with the accompanying sheets of drawings.

BRIEF DESCRIPTION OF THE DRAWINGS

Preferred embodiments of the present invention will now be described with reference to the attached drawings in which;

In FIGS. 1, 2, 3, 5, and 7, the top half of the drawing shows the top portion of the bridge plug while the bottom half of the drawing shows the bottom portion of the bridge plug, with some overlap between the top and bottom halves of the drawing, as indicated. FIG. 17 is a similar view of the retrieving tool.

DETAILED DESCRIPTION OF THE DRAWINGS

Figure 1:
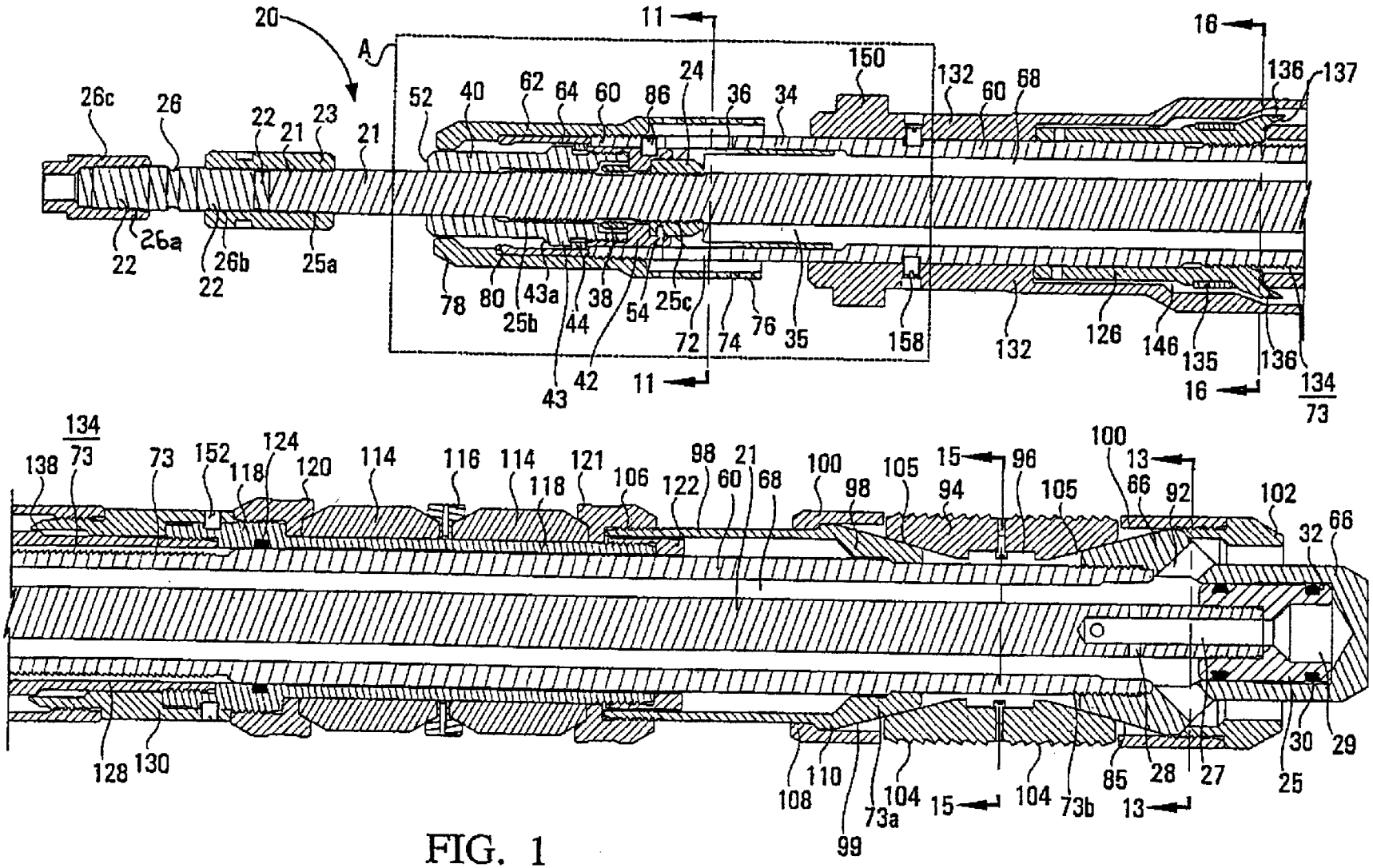
FIG. 1 is a split longitudinal cross-sectional view of a bridge plug according to a preferred embodiment of the present invention, in an open run-in position.
Figure 2:
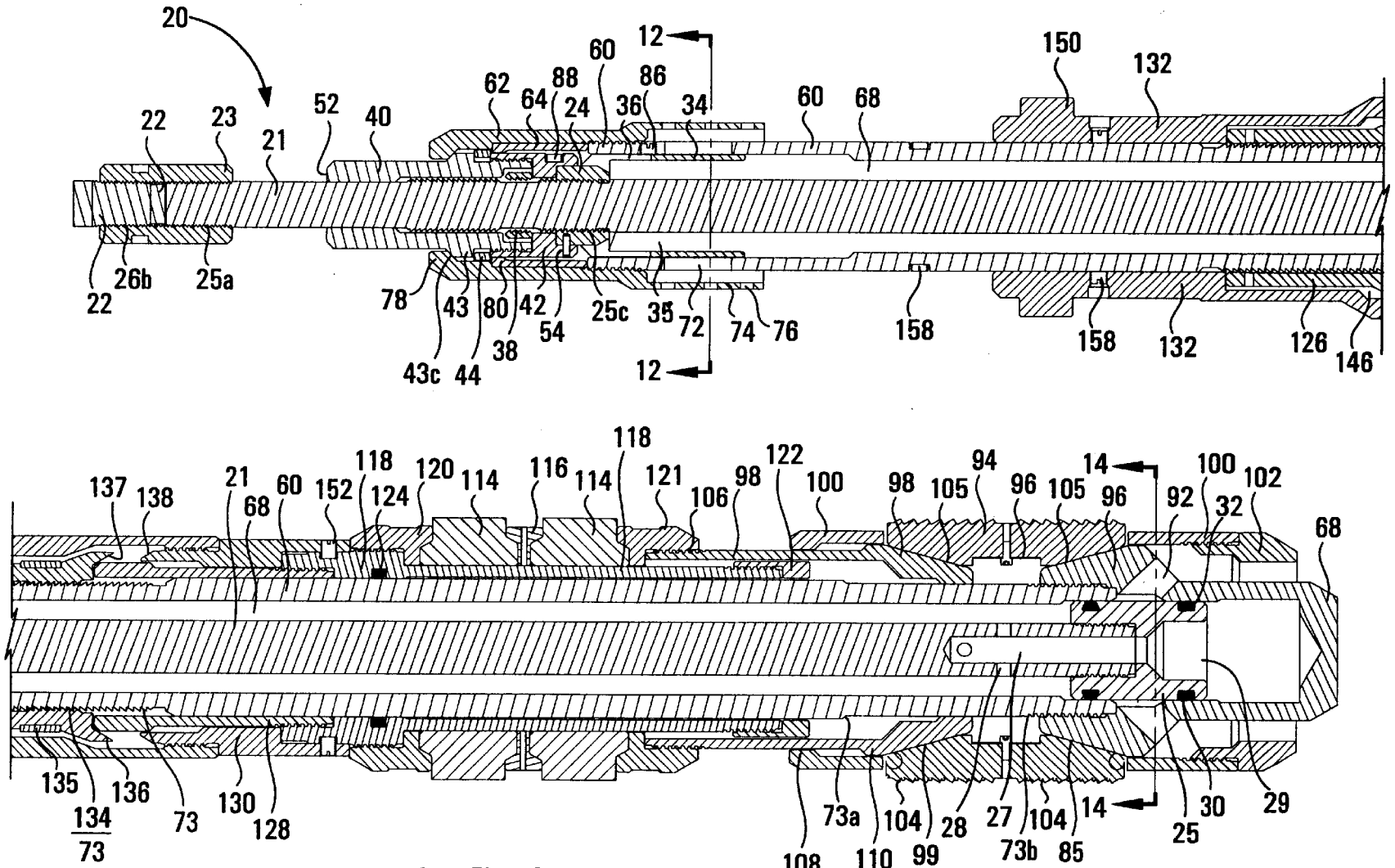
FIG. 2 is a split longitudinal cross-sectional view of the bridge plug of FIG. 1 in a sealed set position.
Figure 3:
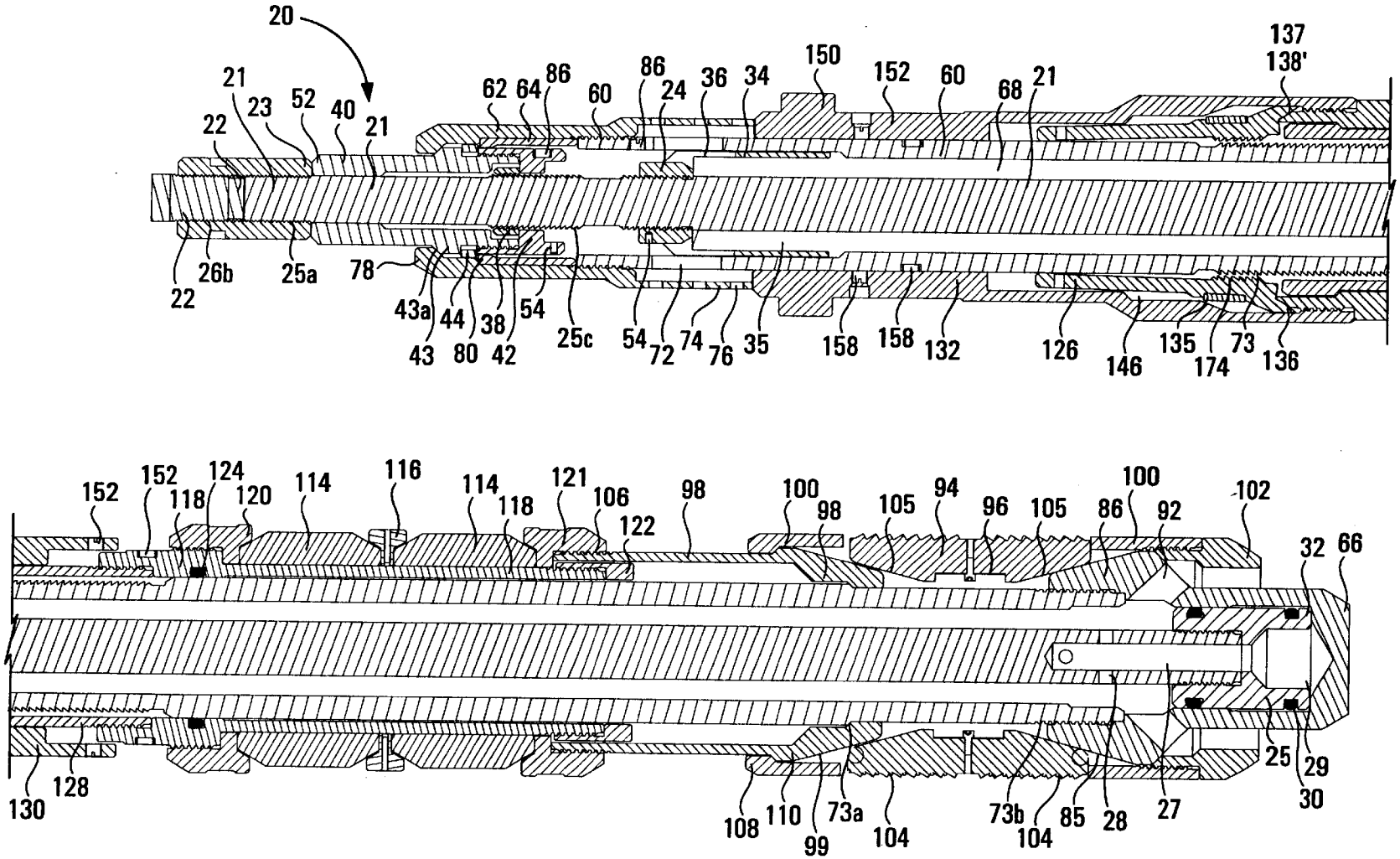
FIG. 3 is a split longitudinal cross-sectional view of the bridge plug of FIG. 1 in a released position.

The retrievable bridge plug according to a preferred embodiment of the present invention is shown in FIGS. 1 through 3 in different operational positions. In FIG. 1, the bridge plug is shown in the open run-in position, in FIG. 2, the bridge plug is shown in the sealed set position, while in FIG. 3, the bridge plug is in the released position.

The bridge plug 20 comprises a prong assembly, prong ratchet assembly, main mandrel assembly, anchor slip assembly, rubber seal assembly, and ratchet assembly. Each assembly includes a plurality of components that move or act together. In describing the components of the bridge plug, the terms "upper", "lower", "uphole", "downhole", "top" and "bottom" are used with reference to the orientation of the bridge plug in the well.

Figure 5:
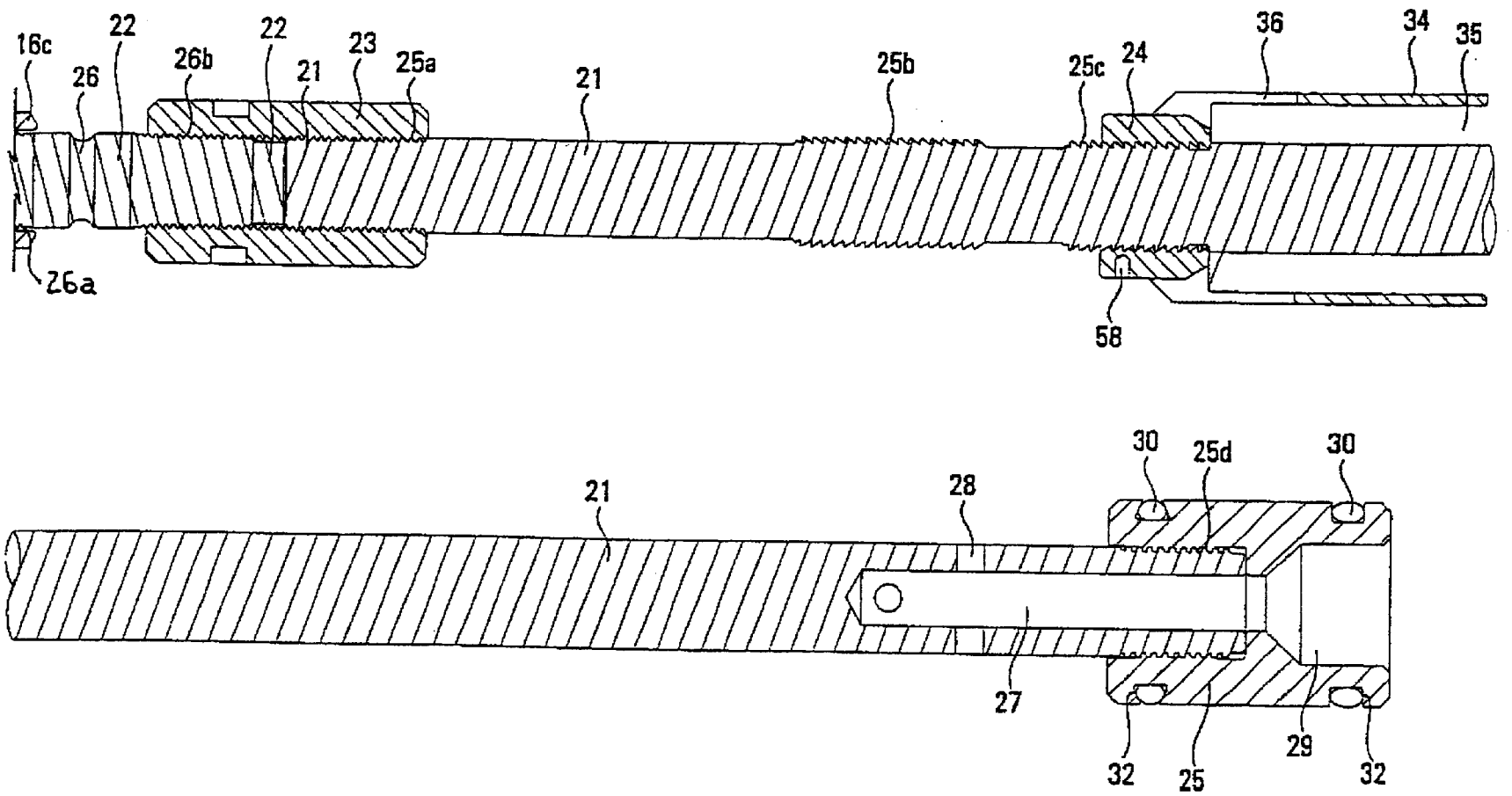
FIG. 5 is a split longitudinal cross-sectional view of the prong assembly of the bridge plug of FIG. 1.

An better seen in FIG. 5, the prong assembly comprises a prong 21, shear stud 22, collar 23, ported sleeve 24, and by-pass piston 25.

The prong 21 is an elongated solid cylinder which forms the core of the bridge plug 20. The prong 21 is provided with a first set of external threading 25*a* at its upper end, and a second set of external threading 25*d* at the bottom end of the prong. A first 23*b* and second 25*c* set of circumferential unidirectional teeth are located intermediate the first 25*a* and second 25*d* sets of external threading. A cylindrical bore 27 is defined longitudinally through the bottom of the prong 21, while a plurality of radial ventilation holes 28 are defined near the top end of the bore 27 to allow communication of fluids between the inside of the cylindrical bore 27 and the outside of the prong 21.

A cylindrical shear stud 22 having a shear constriction 26 and external threading 26*a* and 26*b* at either end, is co-axially mounted to the top of the prong 21. The internally-threaded collar 23 attaches the shear stud 22 to the top end of the prong 21 by way of the external threading 26*b* and 25*a* on the bottom of the shear stud 22, and the top of the prong 21 respectively. The external threading 26*a* at the top of the shear stud 22 accommodates attachment of an insertion tool 26*c* (partially shown) prior to run-in. Once the bridge plug 20 has been run-in and set, sufficient upward or twisting force imparted on the insertion tool 26*c* allows the shear stud 22 to break at the shear constriction 26 allowing the insertion tool to be pulled out of the well bore with the top halt of the shear stud 22.

The by-pass piston 25 is threadably mounted to the second set of external threading 25*d* at the bottom of the prong 21. The by-pass piston is a cylinder having a cylindrical piston bore 29 defined longitudinally therethrough, such that once mounted on the prong 21, fluid may flow through the bottom of the by-pass piston 25, through the piston bore 29 defined therethrough, through the cylindrical bore 27 defined in the bottom of the prong 21 and out the radial ventilation holes 28 defined near the top of the cylindrical bore 27. Resilient O-rings rings 30 are mounted in two grooves 32 defined on the outside surface of the by-pass piston 25 near the top and bottom of the by-pass piston 25.

Figure 11:
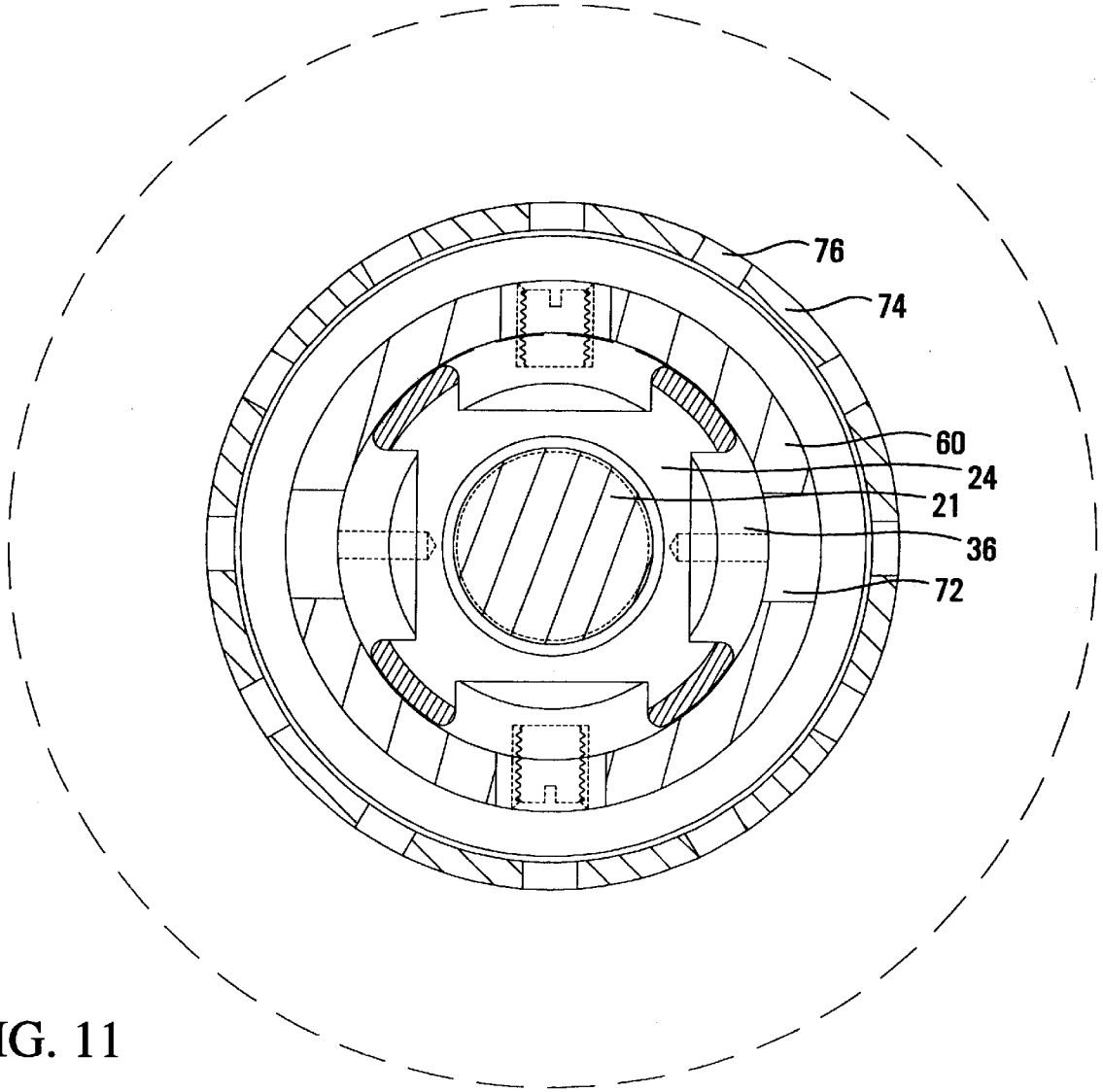
FIG. 11 is a radial cross-sectional view of the bridge plug of FIG. 1, taken along 11—11.

The ported sleeve 24 is an annular cylinder having a downwardly extending movable cover, the sand gate 34. The portion of the sand gate 34 furthest from the annular cylinder portion of the ported sleeve 24 is a solid sleeve having an inner diameter greater than the outer diameter of the prong 21 such that there is space 35 between the prong 21 and this portion of the sand gate 34. The portion of the sand gate 34 closest to the annular cylinder portion of the ported sleeve 24 is a sleeve having ports 36. These ports may be better seen in the cross-sectional view of this portion of the bridge plug 20 shown in FIG. 11. The ported sleeve 24 is threaded onto the second set of external unidirectional teeth 25*c* on the prong 21.

Figure 6:
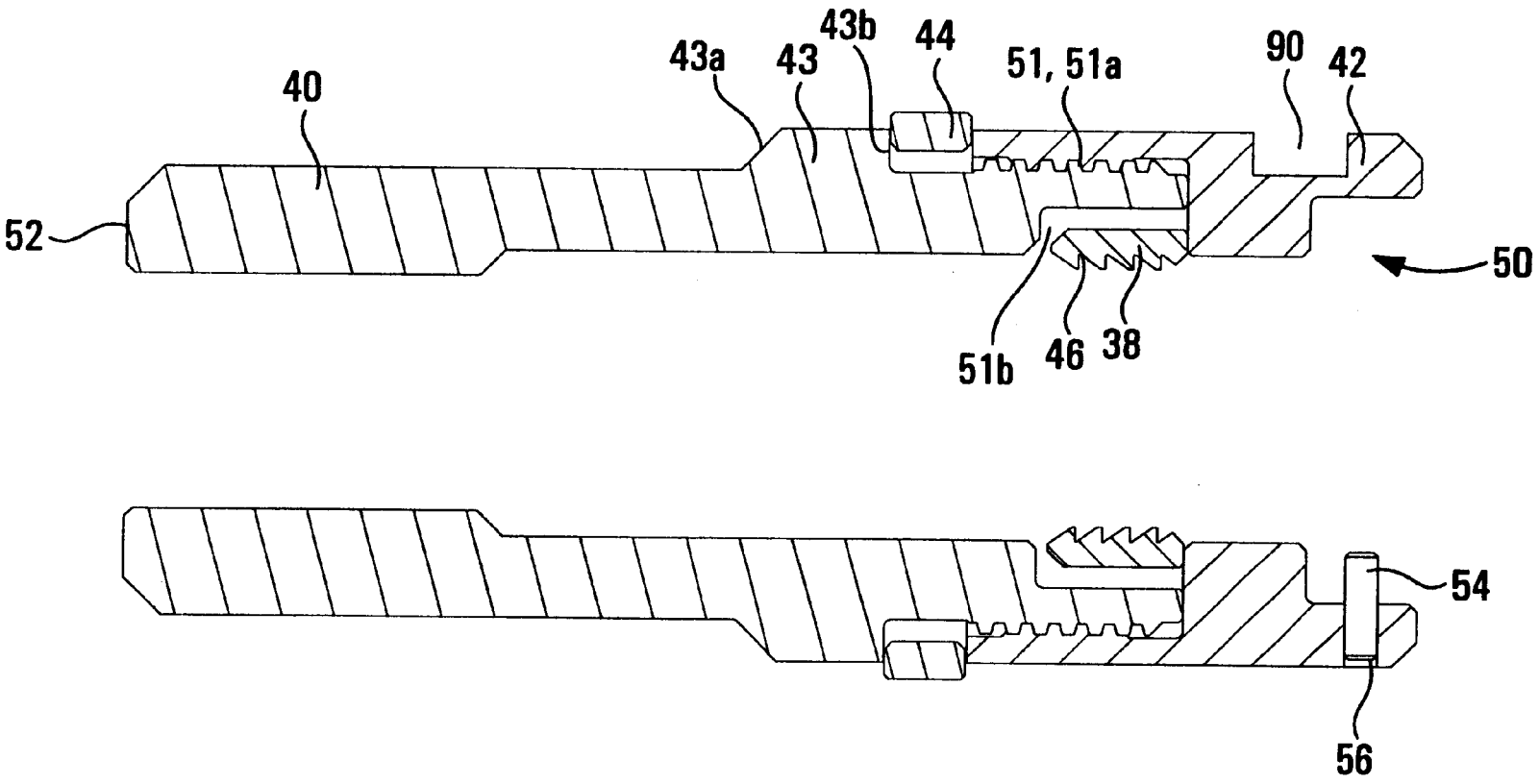
FIG. 6 is a longitudinal cross-sectional view of the prong ratchet assembly of the bridge plug of FIG. 1.

The components of the prong ratchet assembly are shown in FIG. 6. The prong ratchet assembly comprises a prong ratchet 38, prong ratchet cap 40, prong ratchet retainer 42, and "C" ring 44, and serves to control motion of the prong assembly relative to the remainder of the bridge plug 20.

The prong ratchet 38, a "C" collar having unidirectional teeth 46 defined on its inside surface, floats in an internal space formed by the prong ratchet retainer 42 below it, the prong ratchet cap 40 above it and external to it, and the prong 21 on its inside. The prong ratchet 38 is biased inwardly into contact with the external surface of the prong 21. As the prong ratchet assembly slides up the prong 21, the unidirectional teeth 46 defined on the inside surface of the prong ratchet 38 cooperate with the first set of circumferential unidirectional teeth 25*b* formed on the external surface of the prong, for ratcheting motion. Thus, although the prong ratchet 38 is allowed to travel up the prong 21, it is prevented from travelling down the prong.

The prong ratchet retainer 42 is a collar located just below, and outside of the prong ratchet 38. The prong ratchet retainer 42 is formed with an internal circumferential recess 50 at its bottom end to accommodate the upper end of the ported sleeve 24, and internal threading 51 on an upwardly-extending outer sleeve portion at the top of the prong ratchet retainer.

The prong ratchet cap 40 is located above, and external to the prong ratchet 38, and is provided with external threading 51*a* at its bottom end for threadably engaging the internal threading 51 on the prong ratchet retainer 42. The prong ratchet cap 40 is provided with an internal recess 51*b* at its lower end to accommodate the ratchet 38. The prong ratchet cap 40 also has an external circumferential rib 43 having a sloping upper surface 43*a* and a square lower surface 43*b*. The upper end of the prong ratchet cap is provided with a shoulder 52 which may abut against the lower end of the collar 23 to limit upward movement of the prong ratchet assembly.

The expanding "C" ring 44 is located between the lower square surface 43*b* of the circumferential rib 43 and the upper end of the prong ratchet retainer 42. The "C" ring is biased outwardly.

The prong ratchet assembly is initially detachably fixed to the prong assembly by circumferentially-disposed prong-ratchet-assembly/prong-assembly shear pins 54. These shear pins 54 are located within circumferentially-disposed orifices 56 located near the bottom end of the prong ratchet retainer 42, and engage circumferentially-disposed recesses 58 provided near the upper end of the ported sleeve 24. These shear pins 54 will shear and allow relative movement between the prong assembly and the prong ratchet assembly once a given amount of shear force is imparted thereon.

Figure 7:
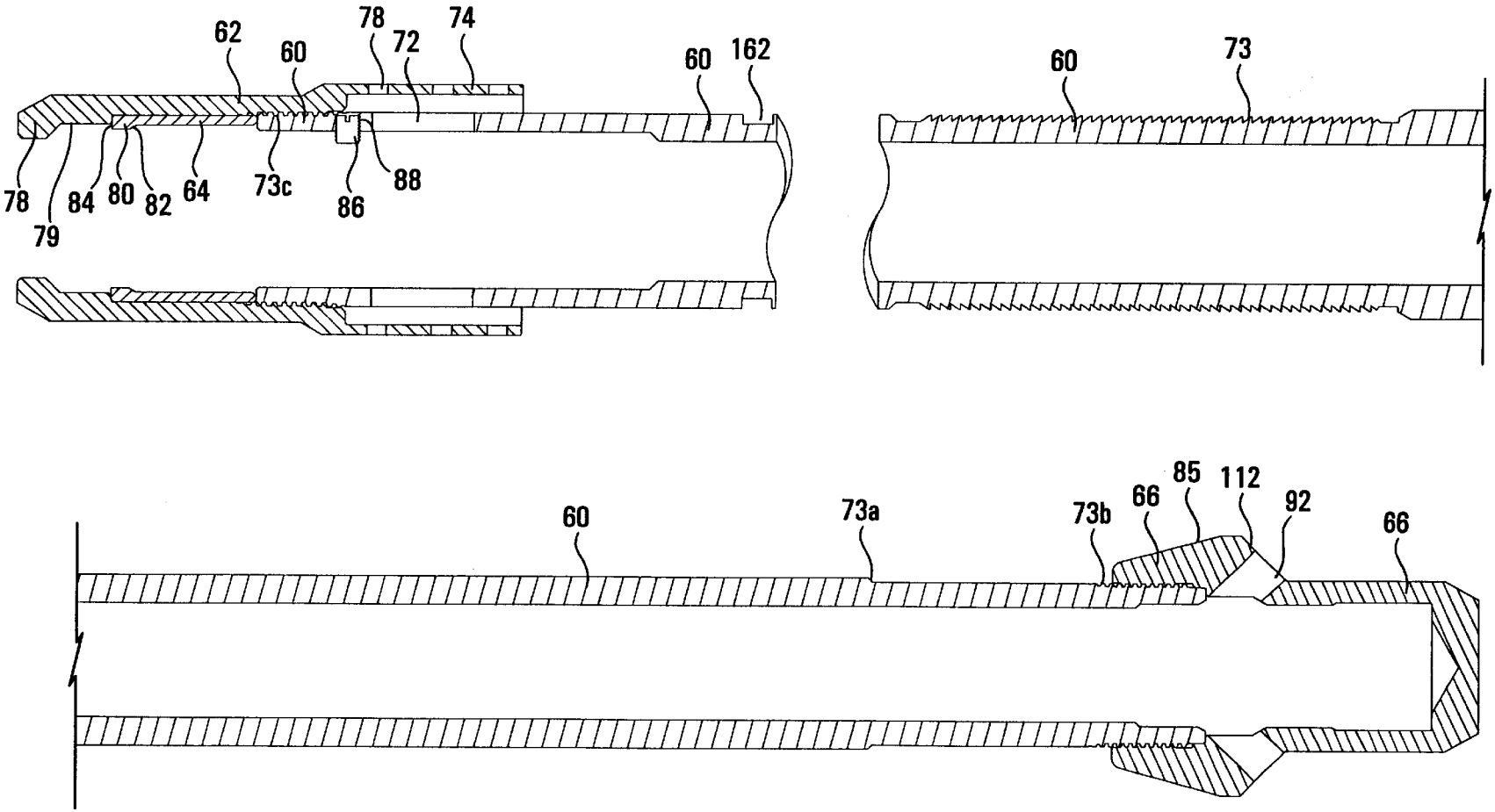
FIG. 7 is a split longitudinal cross-sectional view of the main mandrel assembly of the bridge plug of FIG. 1.

The components of the main mandrel assembly are shown in FIG. 7. The main mandrel assembly comprises a main mandrel 60, sand shroud 62, "C" ring housing 64, and lower cone 66. The main mandrel assembly is mounted on the prong assembly and the prong ratchet assembly, and acts as the mount for the anchor slip assembly, rubber seal assembly, and ratchet assembly. The main mandrel assembly, together with the prong assembly, define the internal bypass passage 68.

Figure 12:
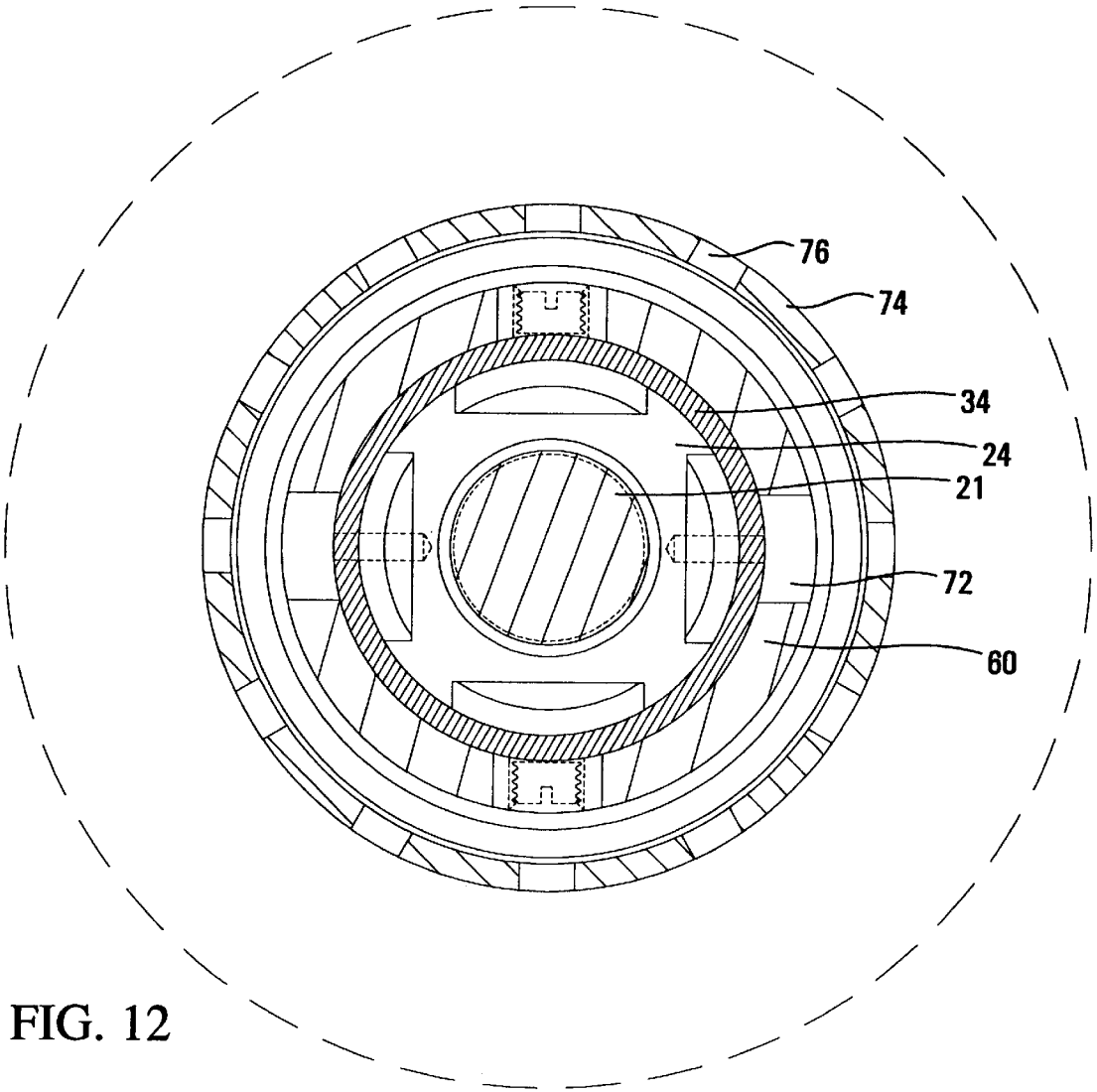
FIG. 12 is a radial cross-sectional view of the bridge plug of FIG. 2, taken along 12—12.

The main mandrel 60 is a hollow cylinder with an inner diameter greater than the outer diameter of the prong 21. The annular space between the main mandrel 60 and the prong 21 forms the bypass passage 68. As better seen in FIG. 11, near the upper end of the main mandrel 60, four longitudinal slots are defined circumferentially around the main mandrel, forming the top opening 72 of the bypass passage 68. As shown in FIGS. 2 and 12, when the bypass passage 68 is in the sealed set position, debris is prevented from entering the bypass passage through this top opening 72 by the sand gate 34 which slides under, and closes this opening. Hence, the sand gate 34 acts as a top bypass closure which may be moved from a first position in which the top opening is open, and a second position in which the top opening is covered by the sand gate 34. Circumferential unidirectional teeth 73 are provided on the exterior surface of the main mandrel 60 at a location intermediate the top opening 72 and the lower cone 66. Intermediate the unidirectional teeth 73 and the lower cone 66, an external shoulder 73*a* is defined on the main mandrel 60. External threading 73*b* is provided on the exterior surface of the main mandrel 60 at its bottom end. External threading 73*c* is also provided on the exterior surface of the main mandrel 60 at its upper end.

Figure 4:
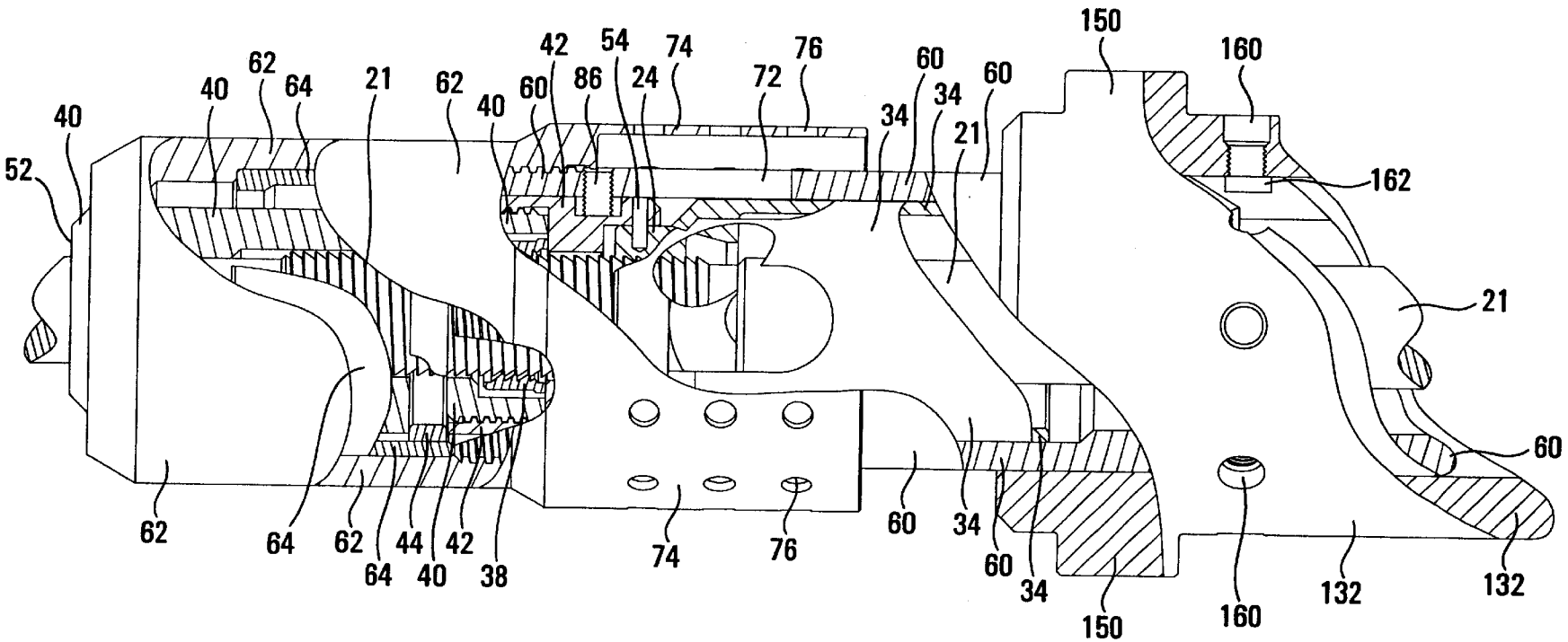
FIG. 4 is a fragmentary partial longitudinal cross-sectional view of the portion of the bridge plug of FIG. 1 marked "A"

The sand shroud 62 is threadably mounted to the external threading 73*c* at the top of the main mandrel 60. The sand shroud 62 has a perforated sleeve 74 extending downward overtop the top opening 72 of the bypass passage 68, which sleeve portion is radially spaced from the main mandrel 60. As better seen in FIG. 4, the perforated sleeve 74 of the sand shroud 62 is provided with perforations 76, This perforated sleeve 74 of the sand shroud 62 prevents debris from packing around the top opening 72 of the bypass passage 68, facilitating venting when the bypass passage in opened. When fluid flows upward through the bypass passage 68, some of the fluid will be allowed to pass through the perforated sleeve 74 via the perforations 76, while the rest of the fluid will be directed downward by the directing sand shroud 62 and the perforated sleeve out the bottom of the perforated sleeve. The upper end of the sand shroud 62 is provided with an inwardly extending lip 78. When the prong ratchet assembly slides up relative to the main mandrel assembly, the sloped upper surface 43*a* of the external circumferential rib 43 of the prong ratchet cap 40 abuts against this inner lip 78 to stop further upward movement of the prong ratchet assembly relative to the main mandrel assembly.

The "C" ring housing 64 is located inside the sand shroud 62 just above the top end of the main mandrel 60. When the bridge plug 20 is in the open run-in position, the "C" ring housing 64 is located outside the expanding "C" ring 44, preventing further expansion of the "C" ring 44. The "C" ring housing 64 is provided with an inner lip 80 at its upper end, which inner lip extends inside the inner surface 79 of the sand shroud 62. This inner lip 80 is provided with a sloping lower surface 82, while the top surface 84 of the inner lip is substantially perpendicular to the length of the "C" ring housing. Thus, as the prong ratchet assembly slides upward relative to the main mandrel assembly, the expanding "C" ring 44 slides along the inside surface of the "C" ring housing 64. As the "C" ring 44 meets the inner lip 80 of the "C" ring housing 64, the "C" ring is constricted by the sloping interface 82. Once the "C" ring 44 passes under the inner lip 80, it is allowed to expand once again, and the prong ratchet assembly is prevented from sliding back downward relative to the main mandrel assembly by the expanded "C" ring abutting against the top surface 84 of the inner lip 80 of the "C" ring housing 64. The distance between this top surface 84 of the inner lip 80 and the inwardly extending lip 78 at the top end of the sand shroud 62 is such that the expanding "C" ring 44 slides under the inner lip 80 of the "C" ring housing 64 just as the external circumferential rib 43 of the prong ratchet cap 40 abuts against the inner lip 78 of the upper end of the sand shroud 62. Hence, once the prong ratchet assembly slides upward sufficiently, relative to the main mandrel assembly, to achieve the position just described, the two assemblies are locked to each other as shown in FIG. 2, and no further relative movement between the two assemblies is permitted.

Figure 13:
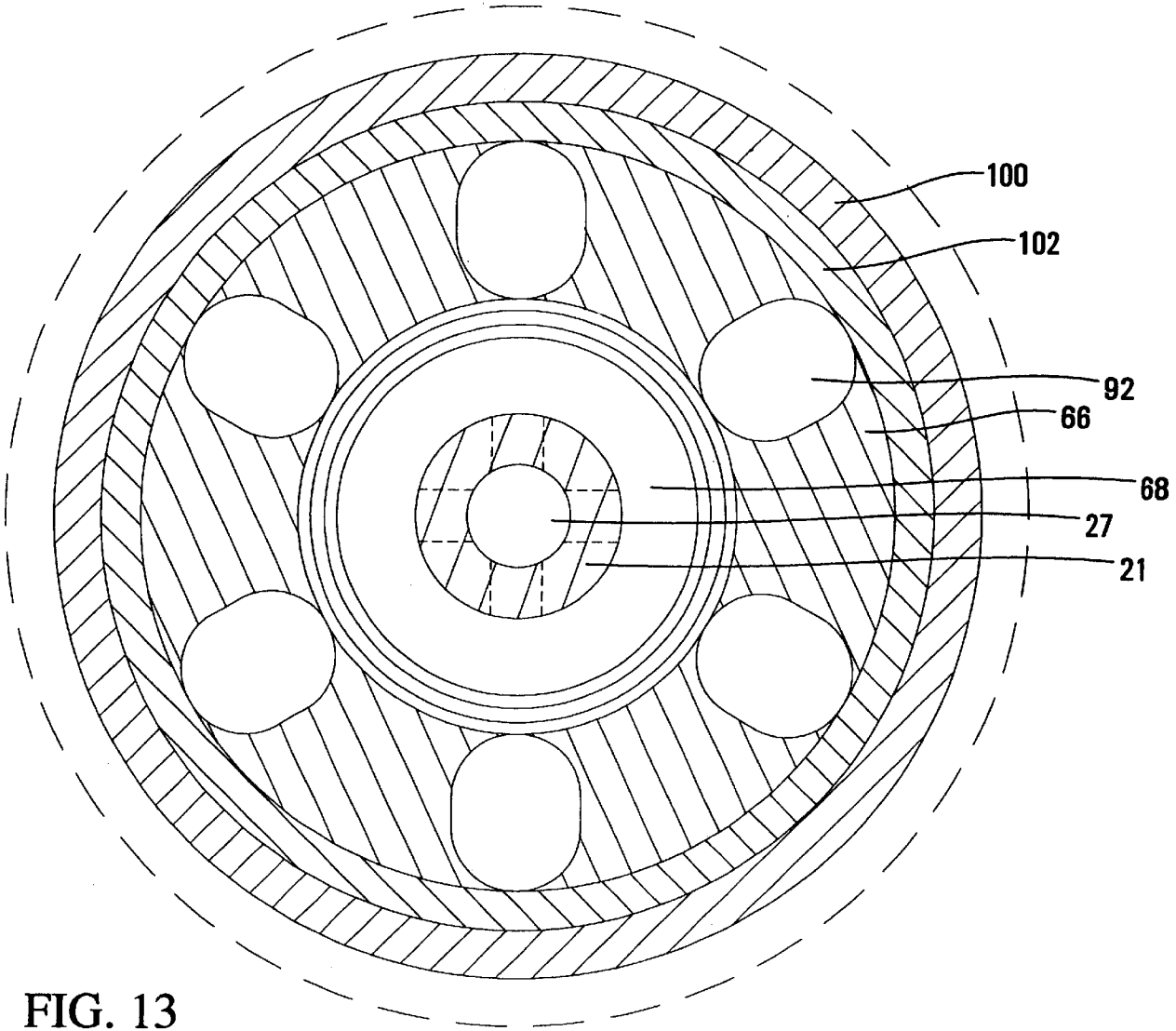
FIG. 13 is a radial cross-sectional view of the bridge plug of FIG. 1, taken along 13—13.
Figure 14:
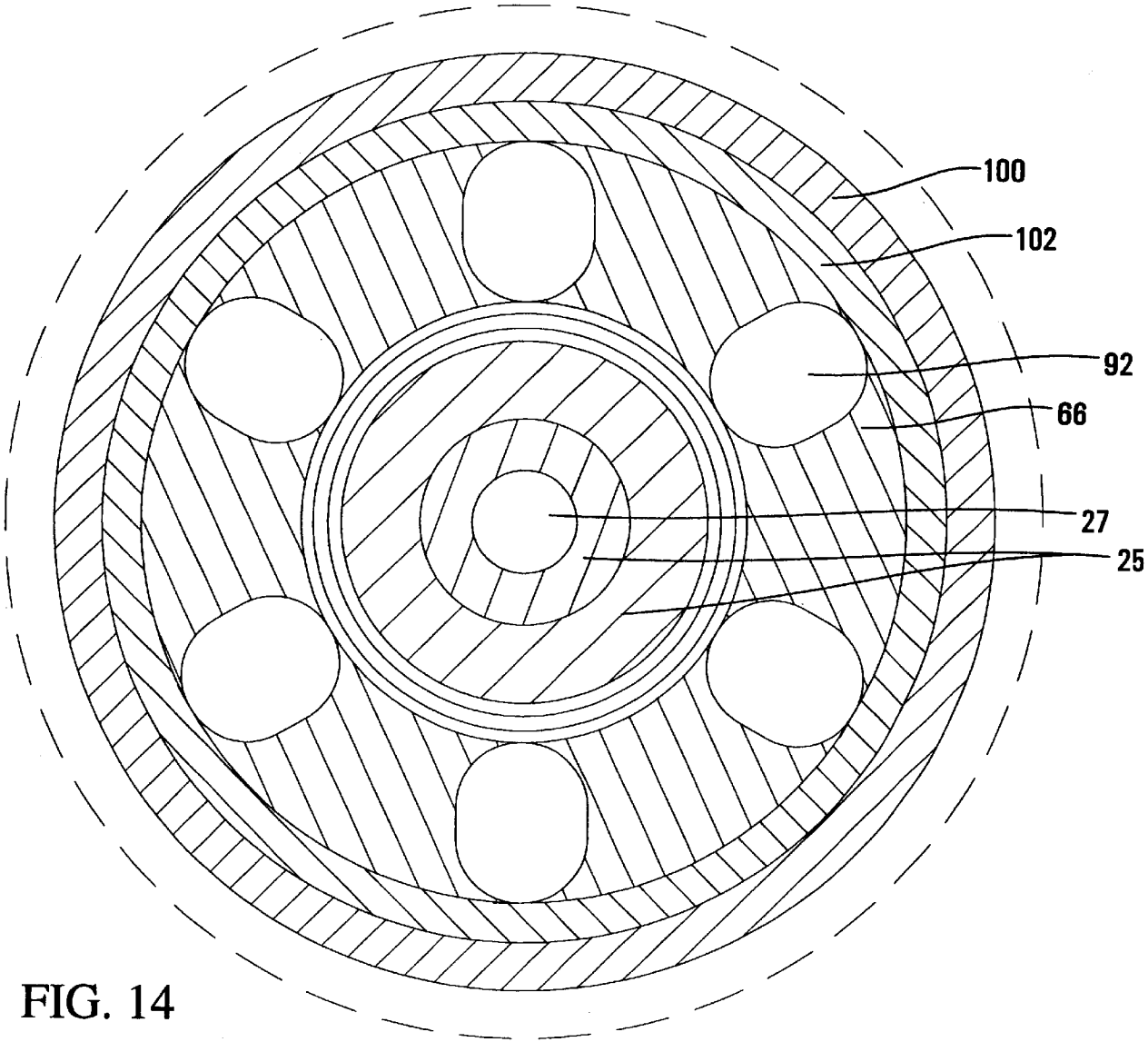
FIG. 14 is a radial cross-sectional view of the bridge plug of FIG. 2, taken along 14—14.

The lower cone 66 is a cup-shaped element threadably affixed to the external threading 73*b* at the bottom of the main mandrel 60. The lower cone 66 and the bypass piston 25 comprise the bypass sealing valve. As best seen in FIG. 13, the lower cone 66 is provided with a plurality of oblique orifices 92 located just below the bottom end of the main mandrel 60. These oblique orifices act as the bottom opening for the bypass passage 68. In its initial position, the bypass piston 25 is seated within the lower portion of the lower cone 66 such that the bypass passage 68 communicates with the exterior of the bridge plug 20 through the oblique orifices 92. However, as shown in FIGS. 2 and 14, as the prong assembly moves upward relative to the main mandrel assembly, the bypass piston 25 slides upward within the lower cone 66, such that the two O-rings 30 lie above and below the oblique orifices 92, forming seals against the inner surface of the bottom end of the main mandrel 60, and against the inner surface of the lower cone 66. In this position, communication between the bypass passage 68 and the exterior of the bridge plug 20 is prevented, and the bypass passage is sealed. of course, as shown in FIG. 3, once the prong assembly then slides downward relative to the main mandrel assembly, the bypass passage 68 is opened once again as the bypass piston 25 seats itself against the lower portion of the lower cone 66, communication between the bypass passage 68 and the exterior of the bridge plug 20 is permitted again, and the bypass passage 68 is open. The by-pass piston 25, lower cone 66, and O-rings 30 therefore comprise a bottom bypass closure, which is movable from a first position in which the bottom opening of the bypass passage 68 is open, and a second position in which the bypass passage is sealed, and the bottom opening is closed off. As the bypass piston 25 slides up and down within the lower cone 66, undesirably high or low pressure in the area between the bypass piston and the bottom cavity of the lower cone is prevented by virtue of fluid communication between this bottom cavity, and the bypass passage 68, through the piston bore 29 formed in the bypass piston 25, the cylindrical bore 27 formed in the bottom of the prong 21, and the ventilation holes 28 formed in the side of the prong. The lower cone 66 is provided with an inwardly sloping external surface 85 at its upper end. Cooperation of the lower cone 66 with the bypass piston 25 as described above comprise the sealing valve.

Cooperation of the main mandrel 60, prong 21, ported sleeve 24, lower cone 66 and bypass piston 25 as described above comprise the bypass sealing mechanism.

The main mandrel assembly is initially detachably fixed to the prong ratchet assembly by circumferentially-disposed disposed main-mandrel/prong-ratchet-assembly shear pins 86. These shear pins 86 are located within circumferentially-disposed orifices 88 located near the top end of the main mandrel 60 and engage circumferentially-disposed recesses 90 located on the exterior surface of the prong ratchet retainer 42. These shear pins 86 will shear and allow relative movement between the main mandrel assembly and the prong ratchet assembly once a given amount of shear force is imparted thereon.

Figure 8:
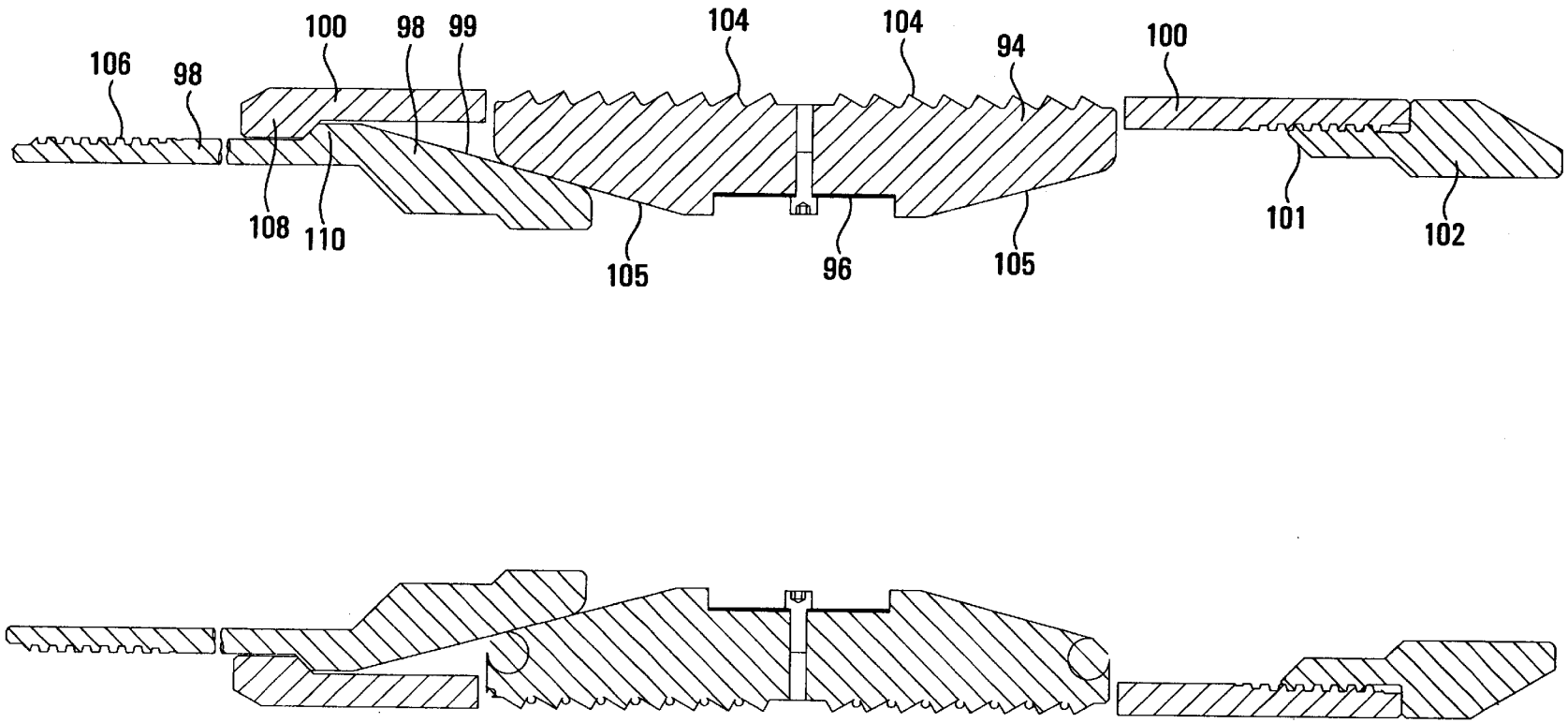
FIG. 8 is a longitudinal cross-sectional view of the anchor slip assembly of the bridge plug of FIG. 1.

The components of the anchor slip assembly are shown in FIG. 8. The anchor slip assembly comprises anchor slips 94, leaf springs 96, upper cone 98, anchor slip cage 100 and slip cage cap 102. The anchor slip assembly is mounted on the main mandrel assembly, and when engaged, secures the bridge plug 20 to the casing.

Figure 15:
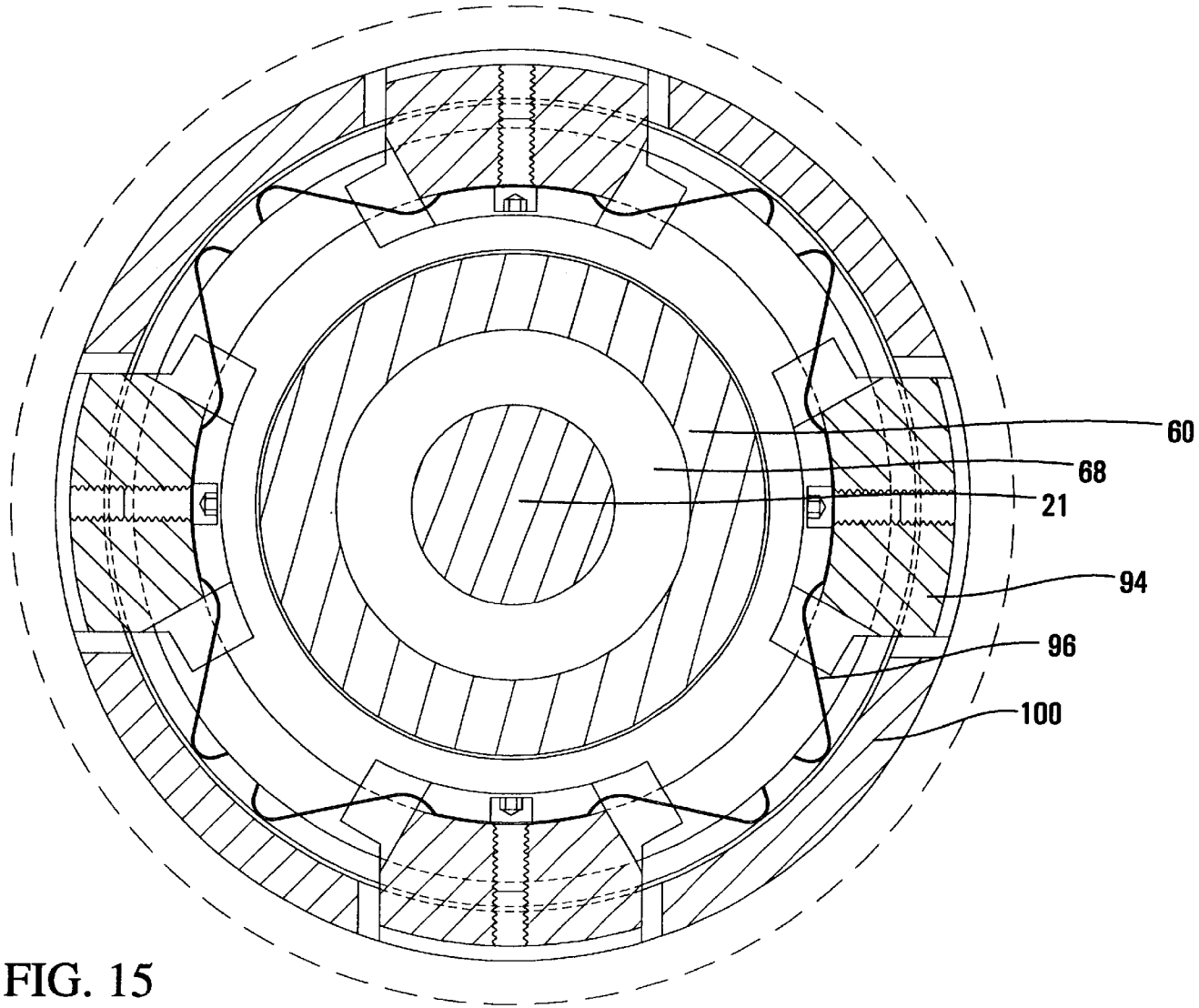
FIG. 15 is a radial cross-sectional view of the bridge plug of FIG. 1, taken along 15—15.

As better seen in FIG. 15, the anchor slips 94 which act as the anchors for the bridge plug, are a series of four longitudinally-extending slips having teeth 104 defined on their external surface. Preferably, these teeth 104 are bi-directional, some pointing down, some pointing up to provide anchoring against either upward or downward forces. The anchor slips 104 are located just above and exterior to the upper end of the lower cone 66, and are provided with sloping interior surfaces 105 as seen in FIGS. 1 and 8. The anchor slips 104 are biased toward their retracted positions toward the interior of the bridge plug 20 by virtue of anchor biasing elements comprising the leaf springs 96.

The upper cone 98 is located above, and interior to the upper end of the anchor slips 94. The lower end of the upper cone 98 is provided with a sloping exterior surface 99. The upper portion of the upper cone 98 is a sleeve having external threading 106 at its upper end.

The sloping exterior surface 85 and 99 of the upper end of the lower cone 66 and the lower end of the upper cone 98 respectively, cooperate with the sloping interior surfaces 105 of the anchor slips 94 to push the anchor slips outward to an extended position when the lower cone and upper cone are moved toward each other. When the lower cone 66 and upper cone 98 are moved apart again, the leaf springs 96 pull the anchor slips 94 back to a retracted position.

The anchor slips 94 are held in position by the anchor slip cage 100, a sleeve located exterior to the lower cone 66, anchor slips and upper cone 98, and having rectangular orifices to allow the anchor slips 94 to extend therethrough when the anchor slips are moved to the extended position. Downward movement of the anchor slip cage 100 relative to the upper cone 98 is limited through abutment of an interior lip 108 at the upper end of the cage with an external shoulder 110 defined on the exterior surface of the upper cone. Upward movement of the anchor slip cage 100 relative to the lower cone 66 is limited through abutment of the upper surface 101 of the slip cage cap 102 which is threaded to the bottom end of the slip cage, against an external shoulder 112 defined on the lower cone.

Figure 9:
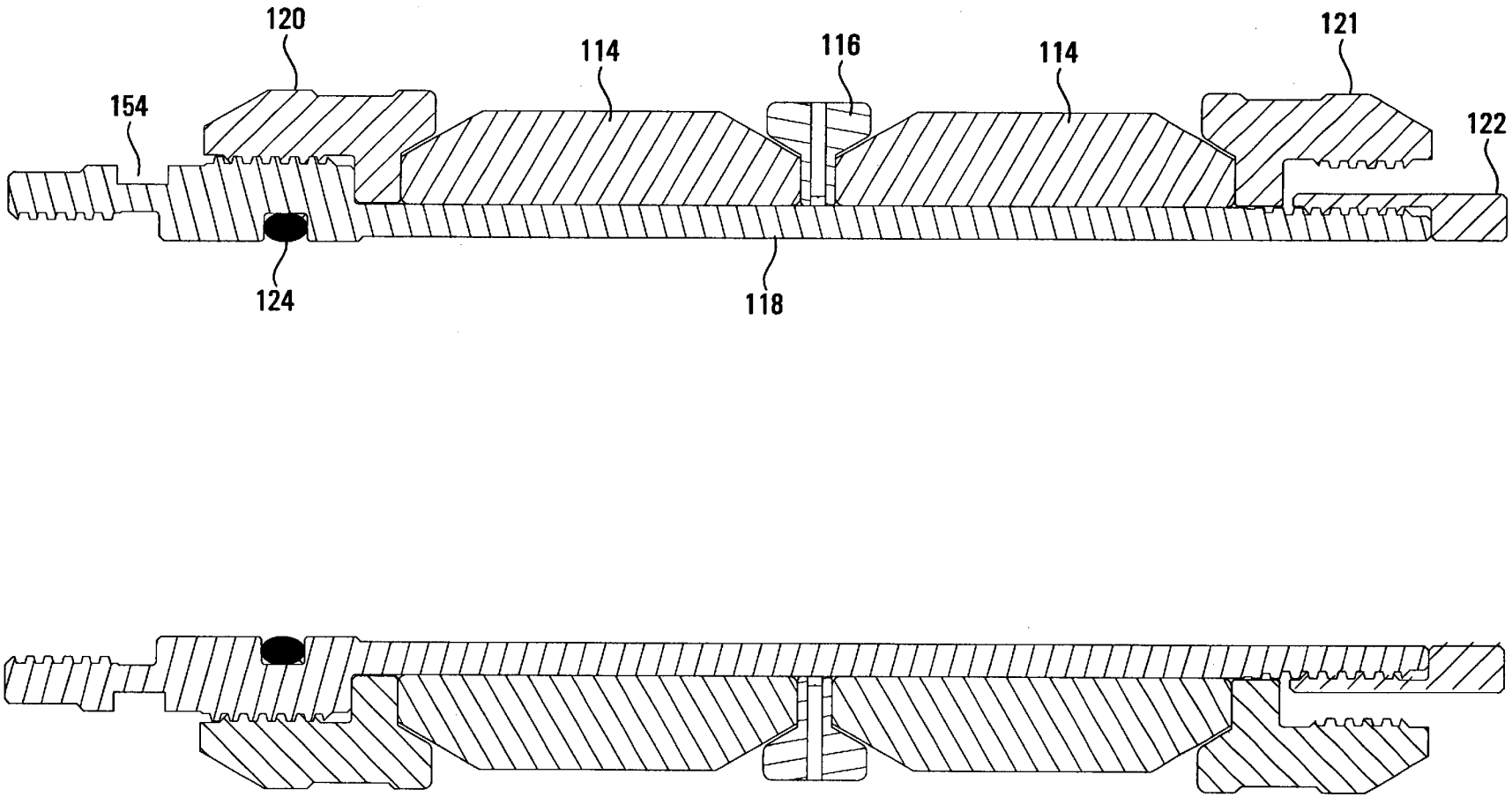
FIG. 9 is a longitudinal cross-sectional view of the rubber seal assembly of the bridge plug of FIG. 1.

The components of the rubber seal assembly are best seen in FIG. 9. The rubber seal assembly is comprised of rubber seal elements 114, element spacer 116, element mandrel 118, upper 120 and lower 121 gauge rings and element mandrel cap 122. The rubber seal assembly is located above the anchor slip assembly, and when engaged, provides a seal between the bridge plug 20 and the casing.

Rubber seal elements 114 which provide the seal between the bridge plug and the well wall, are two generally flat annular resilient elements separated by the element spacer 116. The rubber seal elements 114 are supported by, and lie exterior to the element mandrel 118, and are limited above and below by the two gauge rings 120 and 121. The rubber seal elements 114 are sufficiently malleable such that when the two gauge rings 120 and 121 are moved toward each other, the rubber seal elements extrude outward from their retracted positions as shown in FIG. 1 to their extended positions as shown in FIG. 2, to press against the well casing and form an annular seal between the bridge plug 20 and the well casing. Once the gauge rings 120 and 121 are separated again, the rubber seal elements 114 return to approximately their original shape and position as shown in FIG. 3.

The lower gauge ring 121 is threaded onto the external threading 106 located at the upper end of the upper cone 98 and moves therewith. Each of the lower gauge ring 121, element spacer 116, and rubber seal elements 114 are slidably mounted on and lie exterior to the element mandrel 118. The lower gauge ring 121 is threadably mounted on the element mandrel. Thus, when the lower gauge ring 121 is moved upward, each of the lower gauge ring 121, element spacer 116 and rubber seal elements 114 slide upward on the element mandrel 118 relative to the upper gauge ring 120. Downward movement of the lower gauge ring 121 is limited by abutment of the lower gauge ring against the element mandrel cap 122 threadably mounted to the bottom end of the element mandrel 118. Near the upper end of the element mandrel 118, an internal circumferential recess is provided, housing an O-ring 124. This O-ring 124 prevents leakage of fluids which might otherwise circumvent the seal provided by the rubber seal elements 114 by travelling under the element mandrel 118. The upper end of the element mandrel 118 is provided with internal threading.

Figure 10:
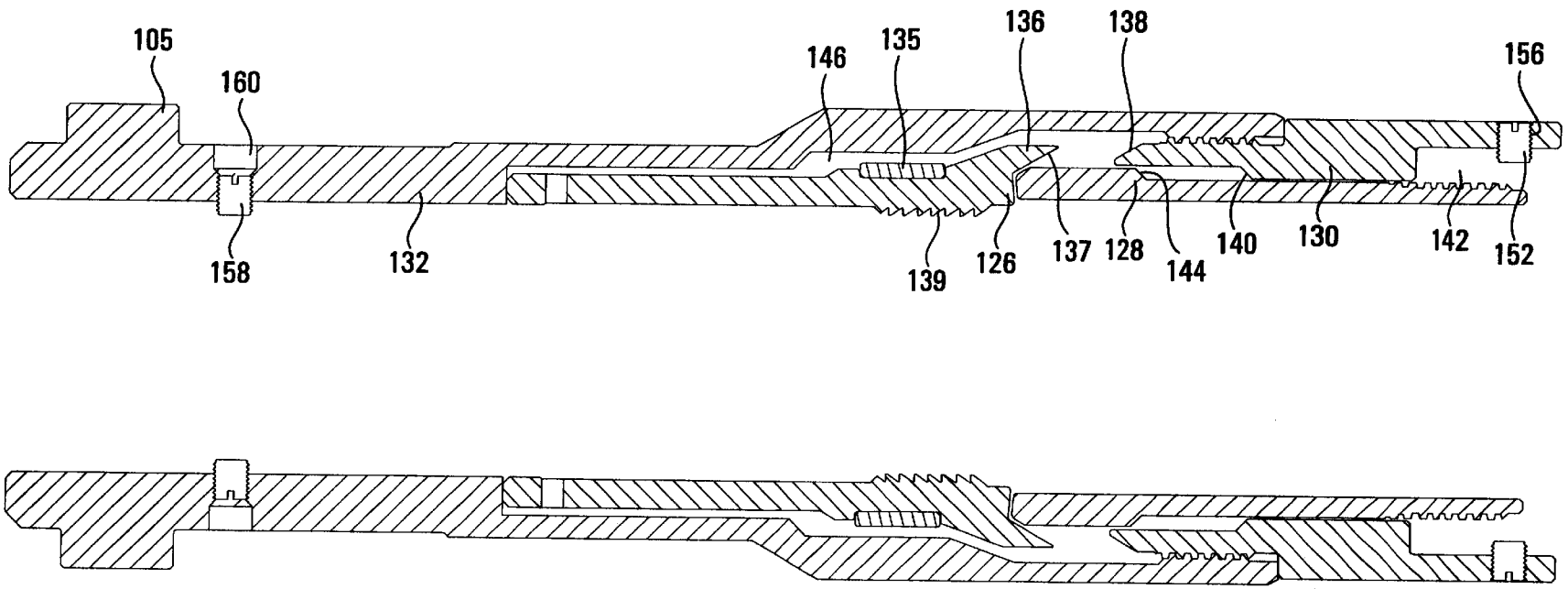
FIG. 10 is a longitudinal cross-sectional view of the ratchet assembly of the bridge plug of FIG. 1.

The components of the ratchet assembly are best seen in FIG. 10. The ratchet assembly comprises a ratchet 126, ratchet release support 128, ratchet release 130 and ratchet housing 132. The ratchet assembly locks the anchor and rubber seal assemblies in their engaged positions until it is desirable to unset the bridge plug 20. The ratchet assembly is located outside of the main mandrel assembly, above the rubber seal assembly, and below the prong ratchet assembly.

Figure 16:
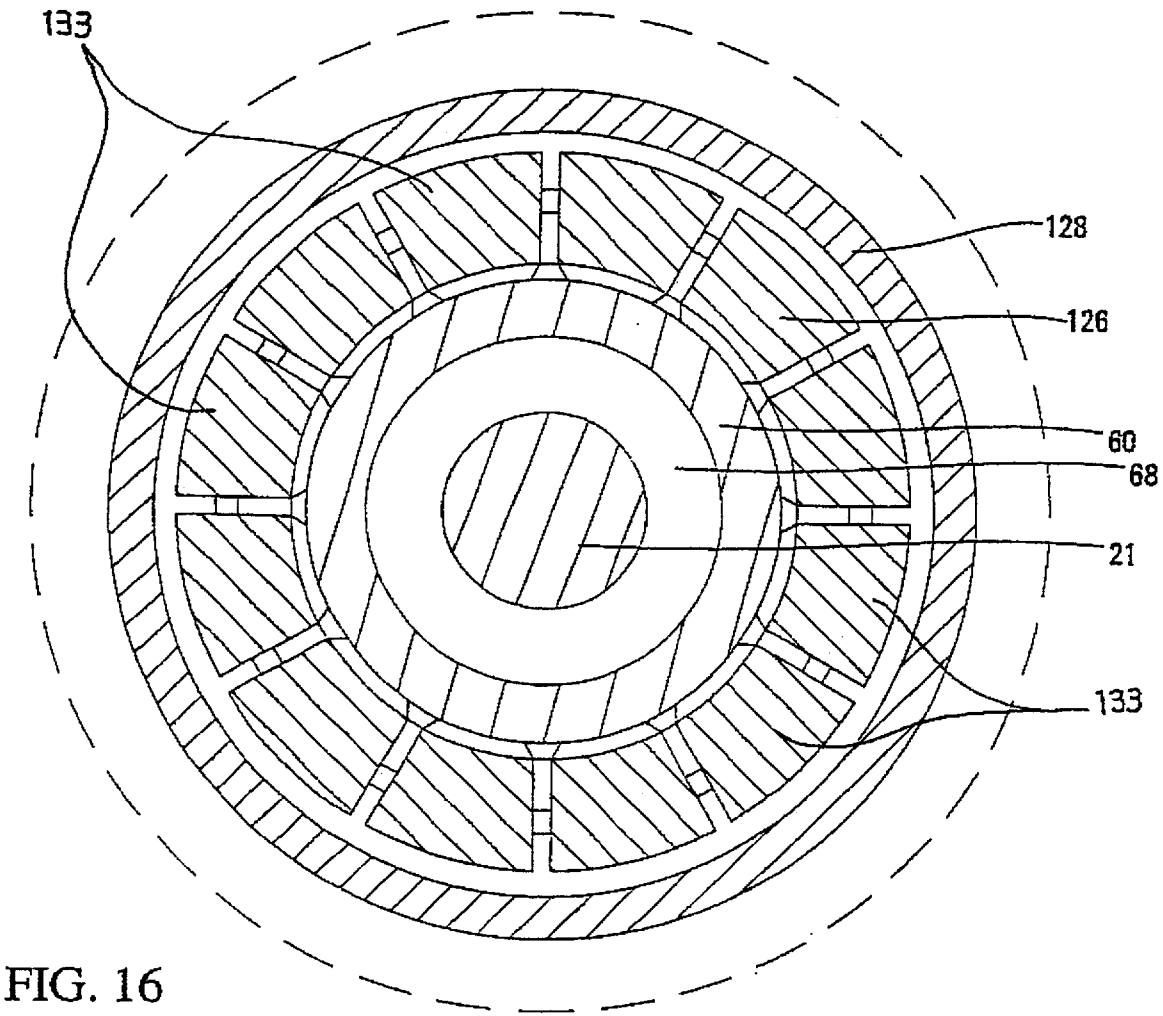
FIG. 16 is a radial cross-sectional view of the bridge plug of FIG. 1, taken along 16—16.

As best seen in FIG. 16, the ratchet 126 is a cluster of longitudinally-elongated elements 133 having unidirectional teeth 134 on an inner surface near the bottom of the elements. These unidirectional teeth 134 cooperate with the unidirectional teeth 73 on the external surface of the main Imandrel 60 to permit the ratchet assembly to move downward relative to the main mandrel, while at the same time preventing upward movement. The elongated elements of the ratchet 126 are biased inwardly by a "C" spring 135 located on an outside surface of the ratchet 126 near its bottom end. The lower end of the ratchet 126 is provided with an external lip 136 having a bottom surface 137 sloping downward and outward.

The ratchet assembly is unlocked by the ratchet release 130. The ratchet release 130 is located below the ratchet 126. The top end of the ratchet release 130 is provided with a sloping surface 138 which slopes downward and outward. When this sloping surface 138 bears against the sloping surface 137 on the bottom of the external lip 136 of the ratchet 126, the bottom portions of the elongated elements 133 comprising the ratchet are forced outward to disengage the unidirectional teeth 134 on the inner surface of the ratchets from the external unidirectional teeth 73 on the main mandrel 60, thereby allowing the ratchet assembly to move upward relative to the main mandrel assembly. The ratchet release 130 is provided with an interior shoulder 140 near its upper end. An internal recess 142 is provided at the bottom of the ratchet release 130. This recess 142 accommodates the upper end of the element mandrel 118.

Movement of the ratchet release 130 is guided by the ratchet release support 128 which lies interior to the ratchet release. The lower end of the ratchet release support 128 is threadably affixed to the upper end of the element mandrel 118. As the ratchet release 130 slides upward relative to the ratchet release support 128, such upward movement is limited by abutment of the interior shoulder 140 of the ratchet against an exterior shoulder 144 located near the upper end of the ratchet release support.

The ratchet 126 is forced downward during setting of the bridge plug 20 by the ratchet housing 132. The ratchet housing 132 is threadably affixed to the upper end of the ratchet release 130, and is provided with an interior recess 146 which accommodates the ratchet 126. The upper end of this recess 146 defines a shoulder 148 which limits upward movement of the ratchet 126 relative to the ratchet housing 132. The ratchet housing 132 is provided with two external retrieving lugs 150 near its upper end. These retrieving lugs act as retrieving tool engaging elements, the engagement points for unsetting the bridge plug. The retrieving lugs 150 are radial protrusions of circular cross-section. These retrieving lugs are used as latch points for the setting tool 26*a* and the retrieval tool 200.

The ratchet assembly is initially detachably fixed to the rubber seal assembly by circumferentially-disposed ratchet-assembly assembly/rubber-seal-assembly shear pins 152. These shear pins 152 are located within circumferentially-disposed orifices 156 located near the bottom ends of the ratchet release 130, and engage circumferentially-disposed external recesses 154 located near the top end of the element mandrel 118. These shear pins 152 will shear and allow relative movement between the ratchet assembly and the rubber seal assembly once a given amount of shear force is imparted thereon.

The ratchet assembly is also initially detachably fixed to the main mandrel assembly by circumferentially-disposed ratchet-assembly/main-mandrel-assembly shear pine 158. These shear pins 158 are located within circumferentially-disposed orifices 160 located near the top end of the ratchet housing 128 just below the retrieving lugs 150, and engage circumferentially-disposed external recesses 162 located on the main mandrel 60, These shear pins 158 will shear and allow relative movement between the ratchet assembly and the main mandrel assembly once a given amount of shear force is imparted thereon.

The components of the various assemblies required to move the rubber seals 114 and anchor slips 94 from their retracted positions to their extended positions, and lock them in their extended positions comprise the bridge plug setting mechanism.

In use, the bridge plug progresses through 5 positions—the open run-in position, the sealed run-in position, the sealed set position, the open set position and the released position.

In the open run-in position as shown in FIG. 1, relative movement between the assemblies of the bridge plug 20 is prevented by the shear pins 54, 86, 152 and 158. The anchor slips 94 and rubber seals 114 are retracted, and the bypass passage 68 is open, since the bypass piston 25 is seated at the bottom of the lower cone 66, and the ports of the ported sleeve 36 are aligned with the top opening 72 of the bypass passage, thus allowing fluid communication between the bypass passage 68 and the exterior of the bridge plug 20.

The insertion tool 26*c* is threaded onto the external threading 26*a* at the upper end of the shear stud 22, while an external portion of the insertion tool 26*c* (not shown) abuts the retrieving lugs 150. The bridge plug 20 is then lowered into the well bore. Because the bypass passage 68 is open, fluid in the bore is allowed to flow through the bypass passage, thereby minimizing fluid resistance, and increasing the speed at which the bridge plug 20 may be lowered into the Well bore.

Once the bridge plug 20 is placed in its desired position, the insertion tool 26*c* imparts an upward force on the shear stud 22, while imparting downward force on the retrieving lugs 150. Once sufficient opposing force is imparted on the bridge plug 20, the main-mandrel/prong-ratchet-assembly shear pin 86 will shear, allowing relative movement between the prong and prong ratchet assemblies on the one hand, and the main mandrel, anchor slip, rubber seal and ratchet assemblies on the other. As the prong assembly moves upward relative to the main mandrel assembly, the sand gate 34 of the ported sleeve 24 slides under the top opening 72 of the bypass passage 68, closing off the top opening, thereby preventing any debris from entering the interior of the bridge plug 20 through this top opening. Since the prong ratchet assembly moves upward along with the prong assembly, once the upper surface 43*a* of the circumferential rib 43 on the prong ratchet cap 40 abuts against the inwardly extending lip 78 at the top end of the sand shroud 62, further upward movement of the prong and prong ratchet assemblies relative to the remainder of the bridge plug is prevented. As described above, in this position, of the "C" ring 44 against the inner lip 80 at the top end of the "C" ring housing 64 prevents any downward movement of the prong and prong ratchet assemblies relative to the rest of the bridge plug 20, and all assemblies of the bridge plug are locked together once again. At the same time, the by-pass piston 25 slides upward within the lower cone 66 until the O-rings mounted on the bypass piston straddle the oblique orifices 92 on the lower cone. The bypass passage 68 is then sealed, with no fluid flow being permitted therethrough. Further, the seal formed at the bottom of the bypass passage 68 prevents any debris from entering the bypass passage. Thus, in this, the sealed run-in position, the bypass passage 68 is closed and sealed, debris is prevented from entering the bypass passage 68 from either the top opening 72 or the oblique orifices 92, and both the anchor slips 94 and rubber seals 114 are still in their retracted positions. Engagement of the "C" ring 44 against the inner lip 80 at the top end of the "C" ring housing 64 as described above prevents inadvertent re-opening of the bypass passage 68.

Further upward force on the shear stud 22, along with downward force on the retrieving lugs 150 commences the setting sequence by virtue of the setting mechanism. This opposing force causes the ratchet-assembly/main-mandrel-assembly shear in 158 to shear. Movement then occurs between the prong assembly, prong ratchet assembly and main mandrel assembly on the one hand, and the anchor slip assembly, rubber seal assembly, and ratchet assembly on the other. The resulting movement of the ratchet assembly toward the lower cone 66 causes the upper cone 98 to move toward this lower cone 66 thereby causing the anchor slips 94 to move outward to their extended positions from their retracted positions to engage the well casing, as more fully described above. Continued opposing force causes the upper gauge ring 120 to move toward the lower gauge ring 121 thereby causing the rubber seals 114 to extrude outward to their extended positions, also as more fully described above. Thus, the engagement of each of the anchor slips 94 and rubber seals 114 against the well casing secures the bridge plug 20 against upward or downward movement within the well bore, while providing a seal between the bridge plug and the well casing. At the same time, as the ratchet assembly moves downward relative to the main mandrel assembly, the unidirectional teeth 134 on the ratchet 126 also moves downward along the unidirectional teeth 73 on the main mandrel 60. Thus, once the anchor slips 94 and rubber seals 114 have fully engaged the well casing, the anchor slip assembly and rubber seal assembly are locked in position by the engagement of the unidirectional teeth 134 on the ratchet 126 with the unidirectional teeth 73 on the main mandrel, as more fully described above. This provides the locking portion of the setting mechanism for locking the anchor slips 94 and rubber seals 114 in their extended positions. The bridge plug 20 is now in the sealed set position, as shown in FIG. 2 with the bypass passage 68 closed and sealed, and the anchor slips 94 and rubber seals 114 locked in their extended positions.

While the bridge plug 20 is in the well casing, debris which may fall on top of the bridge plug as a result of the setting procedure, the workover operation, the retrieval procedure, or which is intentionally placed atop the plug to protect it, is prevented from accumulating adjacent the top opening 72 of the bypass passage 68 by the sand shroud 62 which directs debris away from this top opening.

Once it is desired to unset the bridge plug 20 and remove it from the well bore, a retrieval tool 200 is inserted down the well bore and fluid is circulated in the region above the bridge plug to remove as much of the debris packed on top of the plug as possible. Before unsetting the bridge plug 20, the bypass passage 68 is first opened to equalize pressure across the bridge plug.

The retrieval tool 200 first imparts a downward force on the sheared end of the shear stud 22. With sufficient downward force, accompanied by the resistance offered by the anchor slips 94 which hold the bridge plug 20 in place within the well casing, the prong-ratchet-assembly/prong-assembly shear pin 54 shears allowing the prong assembly to move downward relative to the remainder of the bridge plug 20. The bypass piston 25 moves downward within the main mandrel assembly until it once again seats against the bottom of the lower cone 66 allowing fluid communication between the exterior of the bridge plug 20 and the bypass passage 68 through the oblique orifices 92 of the lower cone. At the same time, the sand gate 34 of the ported sleeve 24 which was located under the top opening 72 of the bypass passage 68 moves downward until the ports 36 of the ported sleeve align with the top opening of the bypass passage, allowing fluid communication between the bypass passage and the exterior of the bridge plug 20 through this top opening. The bypass passage 68 is then open.

The bypass passage 68 is locked in its open position by engagement of the unidirectional teeth 46 on the inside surface of the prong ratchet 38 with the unidirectional teeth **25*b* on the exterior of the prong 21. As the prong assembly moves downward relative to the remainder of the bridge plug 20, the prong ratchet assembly moves upward relative to the prong assembly. Thus, the prong ratchet 38 moves upward to engage the first set of unidirectional teeth 25*b* on the prong 21. Once the bypass piston 25 had seated against the bottom of the lower cone 66, upward movement of the prong assembly relative to the remainder of the bridge plug is prevented due to the engagement of the unidirectional teeth 46 of the prong ratchet 38 with the first set of unidirectional teeth 25*b* on the prong 21, as more fully described above. Thus, inadvertent sealing of the bypass passage 68** is prevented.

Since pressure is normally higher in the area below the plug, once the bypass passage 68 is opened, fluid flows from this area below the plug, through the oblique orifices 92 of the lower cone 66, up the bypass passage 68, past the ports 36 of the ported sleeve 24 and out the top opening 72. As the fluid exits the top opening 72, often at a high flow rate, some of the fluid flows through the perforations 76 of the perforated sleeve 74 of the sand shroud 62, while the remainder of the fluid is forced downward by the directing sand shroud and onto the retrieving lugs 150. This rapid flow of fluid over the retrieving lugs 150 assists in clearing the retrieving lugs of debris, such that the retrieving tool 200 may more easily and more securely latch onto them.

The bridge plug is then in the open set position with the bypass passage 68 open, but with the anchor slip assembly and rubber seal assembly still engaged.

Once pressure has been equalized across the bridge plug 20, the retrieving tool is then allowed to engage the retrieving lugs 150.

The retrieving tool 200 then imparts an upward force on the retrieving lugs of the bridge plug 20. With sufficient upward force, the ratchet-assembly/rubber-seal-assembly shear pins 152 shear, allowing the ratchet housing 132 and ratchet release 130 to move upward relative to the remainder of the bridge plug 20. The rubber seal assembly and anchor slip assembly are held in their engaged positions by the ratchet 126 which still engages the unidirectional teeth 73 on the main mandrel 60. The ratchet release 130 moves up until the sloping surface 138 at the top of the ratchet release bears against the sloping surface 137 of the external lip 136 at the bottom of the ratchet 126. Further upward movement of the ratchet release 130, along with cooperating action between the two sloping surfaces 138 and 137 forces the bottoms of the elements 133 of the ratchet 126 outward, disengaging the unidirectional teeth 134 of the ratchet from the unidirectional teeth 73 on the main mandrel 60. Thus, the lock provided by engagement of the unidirectional teeth 134 and 73 is released. This provides the unlocking portion of the release mechanism for unlocking the anchor slips 94 and rubber seals 114, allowing them to return to their retracted positions.

Release of the ratchet 126 from the main mandrel 60 unsets the bridge plug, as it allows the various components of the rubber seal assembly and the anchor slip assembly to move upward relative to the main mandrel assembly and in particular the lower cone 66. The upper gauge ring 120 of the rubber seal assembly moves away from the lower gauge ring 121, and the rubber seal elements 114 are allowed to relax and retract away from the well casing. The upper cone 98 likewise moves away from the lower cone 66 allowing the leaf spring 96 to pull the anchor slips 94 into a retracted position. This provides the unsetting portion of the release mechanism for urging the anchor slips 94 and rubber seals 114 to their retracted positions.

The bridge plug 20 is now in the released position with the rubber seal and anchor slip assemblies disengaged, and the bridge plug can be removed from the well bore.

Although the operation of the bridge plug 20 of the present invention has been described with the plug being inserted into the well casing in its open run-in position, it is to be understood that the plug may also be inserted into the well casing in its sealed run-in position so as to prevent any debris from entering the interior of the plug and interfering with the proper operation of the plug.

Figure 17:
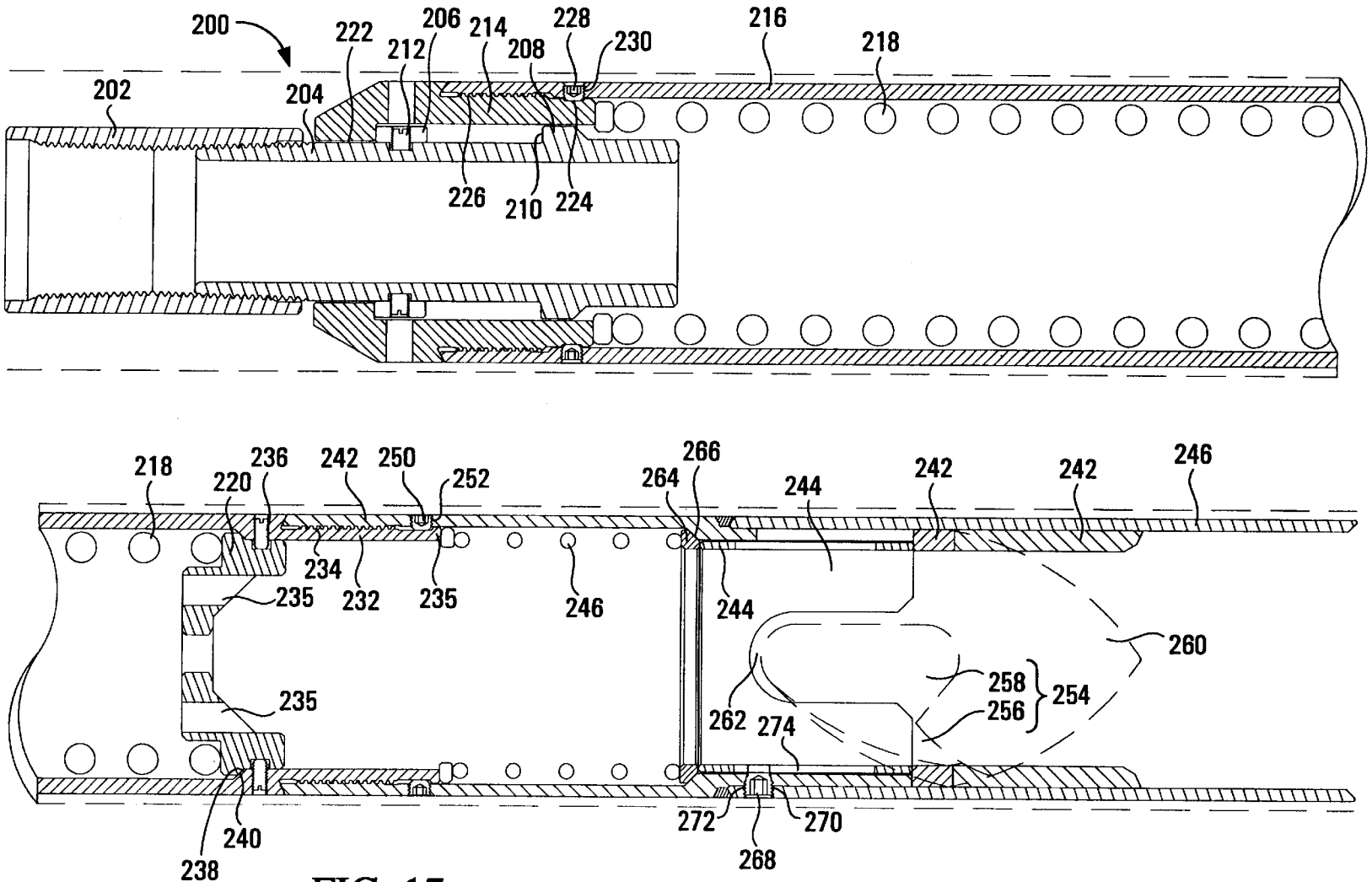
FIG. 17 is a split longitudinal cross-sectional view of a retrieving tool according to an embodiment of the present invention.

The retrieving tool 200 according to an embodiment of the present invention is shown in FIG. 17.

The retrieving tool 200 is comprised of the retrieving tool mandrel assembly, retrieving tool main sleeve assembly, and the retrieving tool latch assembly.

The retrieving tool mandrel assembly is comprised of a top sub 202, mandrel 204, and shear ring 206. A tubing attachment interface is provided by the top sub 202 which is an internally threaded collar which is partially screwed onto the top portion of the mandrel 204. The upper portion of the top sub 202 is screwed onto a threaded bottom portion of tubing (not shown). The retrieving tool 200 is lowered into the well bore on this tubing. The mandrel 204 is a sleeve having an external circumferential rib 208 defined near its bottom end. This circumferential rib 208 has a top surface 210 perpendicular to the length of the mandrel 204. The shear ring 206, is an annular band located on the outside surface of the mandrel at a point intermediate the top sub 202 and the circumferential rib 208. The shear ring 206 is detachably affixed to the mandrel 204 by circumferentially-disposed shear ring shear screws 212.

The retrieving tool main sleeve assembly is comprised of a sleeve cap 214, main sleeve 216, main sleeve spring 218 and guide cap 220. The sleeve cap 214 is a sleeve located outside the mandrel 204. The sleeve cap 214 has an internal lip 222 contacting the external surface of the mandrel 204. This lip 222 is located between the top sub 202 and the shear ring 206. Upward and downward movement of the remainder of the retrieving tool 200 is limited by abutment of this internal lip 222 against the bottom end of the top sub 202 and the top surface of the shear ring 206. The sleeve cap extends downward past the circumferential rib 208 on the mandrel 204. The sleeve cap is also provided with an external circumferential groove 224, above which is external threading 226.

The main sleeve 216 is threaded onto the external threading 226 on the sleeve cap 214. The main sleeve 216 is secured in place by set screws 228 threaded through orifices 230 in the main sleeve to seat in the circumferential groove 224 provided on the sleeve cap 214. The bottom portion 232 of the main sleeve 216 is recessed and is provided with external threading 234. A circumferential external lip 235 is provided at the bottom of the main sleeve 216.

The guide cap 220 is located inside the main sleeve 216 for longitudinal reciprocal movement therein and is adapted to accommodate the shear stud 22 of the bridge plug 20. The guide cap is provided with multiple longitudinal orifices 235 to allow fluid communication therethrough. The guide cap 220 is initially secured near the bottom of the main sleeve 216 by shear screws 236. Further downward movement of the guide cap 220 relative to the main sleeve 216 is prevented by abutment of an external shoulder 238 on the guide cap 220 against an internal shoulder 240 on the main sleeve. The guide cap 220 is biased towards a position away from the sleeve cap 214 by a guide cap biasing element comprising the main sleeve spring 218 located within the main sleeve 216 which bears against the bottom end of the sleeve cap and a top surface of the guide cap.

The retrieval tool latch assembly comprises a retrieving lug guide 242, latch sleeve 244, latch spring 246 and outer sleeve 248. The retrieving lug guide 242 is threaded onto the external threads 234 near the bottom end of the main sleeve 216. The retrieving lug guide 242 is secured in place by set screws 250 located within circumferentially-disposed orifices 252. These set screws 250 prevent downward movement of the retrieving lug guide 242 relative to the main sleeve 216 by abutment of the set screws against the internal lip 235 at the bottom of the main sleeve. The bottom portion of the retrieving lug guide is slightly recessed. This bottom portion of the retrieving lug guide is provided with two "J" shaped slots 254 spaced 180° apart circumferentially, extending upward from a bottom end of the retrieving latch guide 242. Each "J" shaped slot 254 has an upward and obliquely-extending stem portion 256, and a hook portion 258 extending downward from the upper end of the stem portion. Each "J" .shaped slot 254 is sized to accommodate the retrieving lugs 150 of the bridge plug 20. The very bottom of the retrieving lug guide is provided with two downward pointing spade-shaped profiles 260 180° apart circumferentially.

The latch sleeve 244 is mounted for reciprocal longitudinal movement within the retrieving lug guide 242. The latch sleeve 244 is provided with two latch slots 262 spaced 180° apart circumferentially. These latch slots 262 extend upward from the bottom of the latch sleeve 244, and are sized to accommodate the retrieving lugs 150 of the bridge plug 20.

The latch sleeve 244 is initially located within the retrieving lug guide 242 at a location such that the hook portion 258 of the "J" shaped slots 254 substantially align with the latch slots 262, and the remainder of the latch sleeve substantially covers an interface between the hook portion 258 and stem portion 256 of the "J" shaped slots 254 of the retrieving lug guide 260. Further downward progress of the latch sleeve 244 within the retrieving lug guide 242 is prevented by abutment of an external lip 264 at the top of the latch sleeve against an internal shoulder 266 on the retrieving lug guide just above the bottom portion of the retrieving lug guide. The latch sleeve 244 is biased downward relative to the main sleeve 216 by a latch sleeve biasing element comprising the latch spring 246. The latch spring 246 bears against the external lip 264 at the top of the latch sleeve 244 and against the bottom end of the main sleeve 216. Circumferential rotation of the latch sleeve 244 within the retrieving lug guide 242 is prevented by a latch sleeve alignment mechanism comprising circumferentially-disposed guide screws 268 located within circumferentially-disposed orifices 270 and 272 in each of the outer sleeve 246 and the retrieving lug guide 242 respectively and which slide along longitudinal grooves 274 defined in the latch sleeve.

The outer sleeve 246 is affixed to the retrieving lug guide 242 by the guide screws 268, and extends downward.

In use, once it is desired to remove the bridge plug 20 which is in its sealed set position, from the well bore, the retrieving tool is screwed onto the tubing, with the inner threads of the upper portion of the top sub 202 engaging the external threading at the lower end of the coil tubing. The retrieving tool 200 is then lowered into the casing. Once the bottom of the retrieving tool 200 nears the broken portion of the shear stud 22, clean-out fluids are flowed through the interior of the retrieving tool. The clean-out fluids are flowed through the interior of the hollow tubing, through the mandrel 204, main sleeve 216, the orifices 235 in the guide cap 220, the retrieving lug guide 242, latch sleeve 244 and outer sleeve 246. Since further downward flow of the clean-out fluids is blocked by the bridge plug 20, the clean-out fluids are then pushed up through the annular space between the retrieving tool 200 and the casing wall. As the retrieving tool 200 is slowly lowered further, the clean-out fluids serve to clean the top portion of the bridge plug 20 of any debris.

With further lowering of the retrieving tool 200, the shear stud 22 contacts the guide cap 220. Because the guide cap is affixed to the main sleeve 216 by the shear pins 236, the guide cap imparts a downward force on the shear stud 22, which downward force is transferred to the prong 21. As described above, as the prong is pushed downward, the bypass passage 68 in the bridge plug 20 is forced open allowing pressure to equalize across the bridge plug 20.

Once the bypass passage 68 of the bridge plug 20 is completely open, abutment of the lower end of the collar 23 against the upper end of the prong ratchet cap 40 resists any further downward movement of the prong 21 relative to the remainder of the bridge plug 20. With further downward force imparted on the retrieving tool 200, the shear pins 236 will shear, allowing the guide cap to travel upwards within the main sleeve 242, compressing the main sleeve spring 218. This allows the retrieving tool 200 to move lower relative to the bridge plug 20. The outer sleeve 246 is sized such that it will slide over and past the retrieving lugs 150 on the bridge plug 20.

The retrieving lugs 150 will then contact the spade-shaped profile 260 portion of the retrieving lug guide 242. With further downward movement of the retrieving tool 200, this spade-shape imparts an angular force on the retrieving tool latch assembly, forcing it to rotate one way or the other, depending on the location of the spade-shaped profile 260 the retrieving lugs 150 first contact. This angular force in transferred to the retrieving tool main sleeve assembly. By virtue of a rotation mechanism provided by the interaction between the internal lip 222 of the sleeve cap 214 with the shear ring 206, the retrieving tool main sleeve assembly and retrieving tool latch assembly are allowed to rotate relative to the retrieving tool mandrel assembly and the coil tubing. Thus, as the retrieving tool 200 moves lower, the retrieving lugs 150 slide along the bottom surface of the spade-shaped profile 260 of the retrieving lug guide 242, all the while forcing the retrieving tool latch assembly and retrieving tool mandrel assembly to rotate. Once the retrieving lugs 150 enter the stem 256 of the "J"-shaped slots 254 of the retrieving lug guide 242, the retrieving lugs bear against the bottom surface of the latch sleeve 244. With further lowering of the retrieving tool 200, the latch sleeve 244 is forced upward against the downward biasing force provided by the latch spring 246. The latch sleeve 244 is prevented from rotating relative to the retrieving lug guide 260 through cooperation of the guide screw 268 with the longitudinal grooves 274 in the latch sleeve. The upward movement of the latch sleeve 244 allows the retrieving lugs 150 to continue up the stem 256 of the "J" shaped slots 254. Once the retrieving lugs 150 reach the top of the "J" shaped slots 254, the retrieving lugs 150 no longer bear against the bottom surface of the latch sleeve 244, and the retrieving lugs are allowed to enter the latch slots 262, allowing the latch spring 246 to push the latch sleeve 244 back down to its original position. The retrieving lugs 150 are then locked within the hook portions 258 of the "J" shaped slots 254.

The various components of the retrieving tool 200 are sized such that it is not possible for the retrieving lugs 150 of the bridge plug 20 to become locked within the hook portions 258 of the "J" shaped slots 254 until the prong 21 has been pushed down relative to the remainder of the bridge plug 20 sufficiently to open the bypass passage 68, thus preventing a situation where the bridge plug 20 would become unset while the bypass passage 68 is still sealed.

Once the retrieving lugs 150 are locked within the hook portions 258 of the "J" shaped slots 254, the retrieving tool is then pulled up. This upward movement seats the retrieving lugs 150 within the bottom end of the hook portions 258 of the raw shaped slots 254, thereby imparting an upward force on the retrieving lugs 150 while the main sleeve spring 218 provides a downward force on the shear stud 22 and therefore the prong 21. The prong 21 is also held in place by the anchor slip assembly, which is still engaged. As better described previously, these opposing forces serve to disengage both the rubber seal assembly and the anchor slip assembly, allowing both the retrieving tool and the bridge plug to be raised out of the well bore.

The hollow nature of the retrieving tool 200 allows clean-out fluid to continue to flow through the retrieving tool throughout the retrieving process, effecting an improved well clean out.

The opposing forces imparted on the retrieving lugs 150 and the prong 21 also serve to ensure that the lower cone 66 remains well apart from the upper cone 98. In cooperation with the leaf spring 96, the anchor slips 94 are thereby prevented from inadvertently engaging the casing wall during retrieval.

The locking of the retrieving lugs 150 within the hook portions 258 of the "J" shaped slots 254 of the retrieving lug guide 242 of the retrieving tool 200 prevents inadvertent release of the retrieving lugs during retrieval.

If the pulling force on the retrieving lugs 150 exceeds the expected force necessary to normally disengage the rubber seal assembly and anchor slip assembly, the shear ring shear screws 212 shear allowing the shear ring 206 to slam against the upper surface 210 of the circumferential rib 208 of the mandrel 204 quickly and with considerable force. This jarring action will aid disengagement of the rubber seal assembly and anchor slip assembly. If these assemblies still do not disengage, the retrieving tool 200 can then be lowered and then jarred upward again and again to achieve release of these assemblies.

Once the retrieving tool 200 with attached bridge plug 20 has been extracted from the well bore, the bridge plug may be separated from the retrieving tool in the following manner. First, the guide screw 268 is removed. This allows the latch sleeve 244 to rotate relative to the retrieving lug guide 242. By first pushing the bridge plug 20 into the retrieving tool 200, and then rotating it ¼ turn relative to, while pulling it away from, the retrieving tool, the retrieving lugs 150 are allowed to slide to the top of the J-shaped slots 254, and then to exit the J-shaped slots via the stem portion 256 of the J-shaped slots. Hence, the bridge plug 20 is disengaged from the retrieving tool 200.

Although the retrieving tool 200 has been described as being adapted to retrieve a bridge plug, it is to be understood that the retrieving tool can also be used to retrieve other downhole tools adapted to be engaged by it, a packer for example.

Although each of the bridge plug and retrieving tool have been described in great detail, it is to be understood that numerous modifications, variations, and adaptations may be made to the particular embodiments of the invention described above without departing from the scope of the invention which is defined in the claims.

What is claimed is:

1. A bridge plug for use in a well bore having a well wall, the bridge plug comprising:

(a) an elongated body having an internal bypass passage;

(b) anchors mounted on said elongated body, said anchors being extendible from a retracted position, in which they are held out of contact with the well wall, to an extended position in which they engage the well wall;

(c) a seal mounted on said elongated body, said seal being extendible from a retracted position, in which it is held out of contact with the well wall, to an extended position in which it engages the well wall and forms an annular seal between the elongated body and the well wall;

(d) a setting mechanism operable to set and lock said anchors and seal in their extended positions;

(e) said internal bypass passage having a top and a bottom opening, said top opening located uphole from said seal, said bottom opening located downhole from said seal;

(f) a release mechanism operable by a retrieving tool acting upon retrieving tool engaging elements mounted on the elongated body, the bridge plug further comprising a directing shroud located over the top opening of the internal bypass passage thereby substantially protecting the top opening of the internal bypass passage from debris and, when the internal bypass passage is open, directing part of any fluid flowing uphole through the internal bypass passage over the retrieving tool engaging elements;

(g) a top bypass closure adjacent said top opening of the internal bypass passage, and a bottom bypass closure adjacent said bottom opening of the internal bypass passage, each of said top and bottom bypass closures being mounted on said elongated body for movement between a first position in which the internal bypass passage is open, and a second position in which the internal bypass passage is sealed, and the top and bottom openings of the internal bypass passage are closed, substantially preventing debris from entering the internal bypass passage; and (h) a bypass sealing mechanism operable to move said top and bottom bypass closures between said first and second positions.

2. A bridge plug for use in a well bore having a well wall, the bridge plug comprising:

(a) an elongated body having an internal bypass passage;

(b) anchors mounted on said elongated body, said anchors being extendible from a retracted position, in which they are held out of contact with the well wall, to an extended position in which they engage the well wall;

(c) a seal mounted on said elongated body, said seal being extendible from a retracted position, in which it is held out of contact with the well wall, to an extended position in which it engages the well wall and forms an annular seal between the elongated body and the well wall;

(d) a setting mechanism operable to set and lock said anchors and seal in their extended positions;

(e) a release mechanism operable to disengage said anchors and seal from the well wall;

(f) said internal bypass passage having a top and a bottom opening, said top opening located uphole from said seal, said bottom opening located downhole from said seal;

(g) a movable cover adjacent the top opening forming a top bypass closure adjacent said top opening of the internal bypass passage, and a bottom bypass closure adjacent said bottom opening of the internal bypass passage, each of said top and bottom bypass closures being mounted on said elongated body for movement between a first position in which the internal bypass passage is open, and a second position in which the internal bypass passage is sealed, and the top and bottom openings of the internal bypass passage are closed, substantially preventing debris from entering the internal bypass passage; and (h) a bypass sealing mechanism operable to move said top and bottom bypass closures between said first and second positions.

3. The bridge plug of claim 2 wherein the bottom bypass closure comprises a sealing valve located adjacent the bottom opening of the internal bypass passage.

4. The bridge plug of claim 3 wherein the bridge plug has a top end, a side and a bottom end, said top opening of the internal bypass passage being located on the side of the bridge plug and the movable cover being a sleeve slidably mounted adjacent said top opening of the internal bypass passage.

5. The bridge plug of claim 4 wherein the sealing valve is comprised of a piston having at least one seal mounted thereon, slidably mounted adjacent the bottom opening of the internal bypass passage.

6. The bridge plug of claim 5 wherein movement of the sleeve and piston are synchronized.

7. The bridge plug of claim 6 wherein the bypass sealing mechanism comprises an elongated prong upon which each of the sleeve and piston are mounted, the elongated prong being slidably mounted within the bridge plug for reciprocal longitudinal movement therein, whereby the top and bottom bypass closures may be moved between their first and second positions by manipulkating the elongated prong.

8. The bridge plug of claim 7 wherein said release mechanism is operable by a retrieving tool acting upon retrieving tool engaging elements mounted on the elongated body, the bridge plug further comprising a directing shroud located over the top opening of the internal bypass passage thereby substantially protecting the top opening of the internal bypass passage from debris and, when the internal bypass passage is open, directing part of any fluid flowing uphole through the internal bypass passage over the retrieving tool engaging elements.

9. A bridge plug for use in a well bore having a well wall, the bridge plug comprising:

(a) an elongated body having an internal bypass passage;

(b) anchors mounted on said elongated body, said anchors being extendible from a retracted position, in which they are held out of contact with the well wall, to an extended position in which they engage the well wall;

(c) a seal mounted on said elongated body, said seal being extendible from a retracted position, in which it is held out of contact with the well wall, to an extended position in which it engages the well wall and forms an annular seal between the elongated body and the well wall;

(d) a setting mechanism operable to set and lock said anchors and seal in their extended positions;

(e) a release mechanism operable to disengage said anchors and seal from the well wall, said release mechanism being operable by a retrieving tool acting upon retrieving tool engaging elements mounted on the elongated body;

(f) said internal bypass passage having a top and a bottom opening, said top opening located uphole from said seal, said bottom opening located downhole from said seal;

(g) a directing shroud located over the top opening of the internal bypass passage;

(h) a bypass sealing mechanism operable to selectively open and seal said internal bypass passage, whereby the directing shroud substantially protects the top opening of the internal bypass passage from debris and, when the internal bypass passage is open, directs part of any fluid flowing uphole through the internal bypass passage over the retrieving tool engaging elements.

10. The bridge plug of claim 9 wherein the directing shroud is perforated.

11. The bridge plug of claim 9 wherein the top opening of the internal bypass passage is located uphole of the retrieving tool engaging elements.

12. The bridge plug of claim 11 wherein the directing shroud is perforated.

13. The bridge plug of claim 12 wherein the retrieving tool engaging elements are a plurality of radially-protruding retrieving lugs.

14. The bridge plug of claim 13 further comprising a top bypass closure adjacent said top opening of the internal bypass passage, and a bottom bypass closure adjacent said bottom opening of the internal bypass passage, each of said top and bottom bypass closures being mounted on said elongated body for movement between a first position in which the internal bypass passage is open, and a second position in which the internal bypass passage is sealed, and the top and bottom openings of the internal bypass passage are closed, substantially preventing debris from entering the internal bypass passage, the bypass sealing mechanism being operable to move said top and bottom bypass closures between said first and second positions.

15. A bridge plug/retrieving tool combination for use in a well bore having a well wall comprising the bridge plug of claim 9; and, a retrieving tool adapted to actuate the release mechanism to retract the anchors to their retracted positions, and to maintain said anchors in their retracted positions while the bridge plug is raised out of the well bore.

16. The bridge plug/retrieving tool combination of claim 15 wherein each of the anchors have an interior surface sloping outward towards a top and a bottom end of said anchors, and said release mechanism comprises an anchor biasing element for biasing the anchors to their retracted positions, a lower cone located downhole of the anchors, and an upper cone located uphole of the anchors, each of said cones having external surfaces adapted to cooperate with the sloping interior surfaces of the anchors to permit the anchor biasing element to urge the anchors to their retracted positions as the lower cone is moved away from the upper cone.

17. The bridge plug/retrieving tool combination of claim 16 wherein the release mechanism is actuated by pulling up on transversely-extending retrieving lugs connected to the upper cone while pushing down on a central prong connected to the lower cone.

18. The bridge plug/retrieving tool combination of claim 17 wherein the retrieving tool actuates, and maintains actuation of the release mechanism by latching onto the retrieving lugs and imparting an upward force thereon as the retrieving tool is lifted, while a central prong biasing element located within the retrieving tool imparts a downward force on the central prong, whereby once the release mechanism is actuated, and the anchors are urged to their respective positions, these retracted positions are maintained as the retrieving tool and bridge plug are pulled up and out of the well bore.

19. The bridge plug/retrieving tool combination of claim 18 wherein the anchor biasing element is a leaf spring.

20. The bridge plug/retrieving tool combination of claim 19 wherein the central prong biasing element is a coil spring urging a guide cap adapted to accept an upper end of the central prong, downward relative to the remainder of the retrieving tool.

* * * * *

UNITED STATES PATENT AND TRADEMARK OFFICE

CERTIFICATE OF CORRECTION

PATENT NO. : 6,220,348 B1
DATED : April 24, 2001
INVENTOR(S) : Vitold Serafin et al.

It is certified that error appears in the above-identified patent and that said Letters Patent is hereby corrected as shown below:

Column 20,
Line 30, change "manipulkating" to -- manipulating --.

Signed and Sealed this

Twenty-third Day of April, 2002

*Attest:*

*Attesting Officer*

JAMES E. ROGAN
*Director of the United States Patent and Trademark Office*